US005139929A

United States Patent [19]

Ishikawa et al.

[11] Patent Number: 5,139,929

[45] Date of Patent: Aug. 18, 1992

[54] METHOD FOR PROCESSING A SILVER HALIDE COLOR PHOTOGRAPHIC MATERIAL

[75] Inventors: Takatoshi Ishikawa; Shinji Ueda, both of Kanagawa, Japan

[73] Assignee: Fuji Photo Film Co., Ltd., Kanagawa, Japan

[21] Appl. No.: 555,016

[22] Filed: Jul. 20, 1990

[30] Foreign Application Priority Data

Jul. 21, 1989 [JP] Japan ..... 1-187475

[51] Int. Cl.[5] ..... G03C 5/395

[52] U.S. Cl. ..... 430/400; 430/393; 430/398; 430/430; 430/460

[58] Field of Search ..... 430/393, 398, 400, 430, 430/460

[56] References Cited

U.S. PATENT DOCUMENTS

| | | | |
|---|---|---|---|
| 4,033,771 | 7/1977 | Burton et al. | 430/393 |
| 4,830,948 | 5/1989 | Ishikawa et al. | 430/400 |
| 4,837,140 | 6/1989 | Ikeda et al. | 430/400 |
| 4,939,074 | 7/1990 | Ishikawa | 430/399 |
| 4,954,426 | 9/1990 | Ishikawa | 430/400 |

FOREIGN PATENT DOCUMENTS

| | | |
|---|---|---|
| 63-46460 | 2/1988 | Japan . |
| 63-280248 | 11/1988 | Japan . |

*Primary Examiner*—Hoa Van Le

*Attorney, Agent, or Firm*—Sughrue, Mion, Zinn, Macpeak & Seas

[57] ABSTRACT

A method for processing an exposed silver halide color photographic material comprising the steps of:

(a) color developing an exposed silver halide color photographic material;

(b) bleach-fixing said developed material;

(c) at least one of washing said bleach-fixed material with water and stabilizing said bleach-fixed material;

(d) regenerating a portion of a solution from said step (b) for bleach-fixing to form a replenisher solution comprising at least a carbonyl bisulfite adduct; and (e) replenishing at least one solution in said bleach-fixing step (b) with said replenisher solution from step (d).

26 Claims, No Drawings

METHOD FOR PROCESSING A SILVER HALIDE COLOR PHOTOGRAPHIC MATERIAL

FILED OF THE INVENTION

This invention relates to a method for processing a silver halide color photographic material and, more particularly, to a continuous processing method in which a spent bleach-fix bath is reused as a replenisher to reduce waste liquid and running cost.

BACKGROUND OF THE INVENTION

In processing of silver halide color photographic materials, spent processing solutions are generally discarded as an overflow. However, recovered and disposed spent processing solutions cause great environmental pollution and are unfavorable for environmental conservation. Also, the cost incurred for the recovery is not negligible. If these spent processing solutions (overflows) could be reused as a replenisher, it would offer a solution to the environmental and economic problem. In addition, since active components remaining in the overflow could be utilized, the amounts of chemicals necessary for preparing a replenisher would be significantly reduced as compared with preparing a fresh replenisher to thereby further reduce the cost. Extensive studies have been directed to regeneration of spent processing solutions to make them reusable by correcting the changes brought about during processing, generally by removal of accumulated components which adversely affect photographic properties and replacing the consumed components.

With respect to a bleach-fix bath used for processing color photographic materials, various efforts have also been made to develop techniques of regeneration.

A bleach-fix bath generally contains chemicals for at least three functions, i.e., an aminopolycarboxylic acid iron (III) complex serving as a bleaching agent, a thiosulfate serving as a fixing agent, and a sulfite serving as a preservative. An overflow of the bleach-fix bath additionally contains silver ion produced by desilvering action and color developer components which have been carried over from the prebath. The overflow further contains an iron (II) aminopolycarboxylate resulting from oxidation of silver to silver ions.

As described above, regeneration of a processing solution generally requires removal of harmful accumulated components and addition of consumed components, and how to effectively remove the accumulated components has been a problem waiting for a solution. In order to solve this problem, various regeneration systems for removing or reducing silver ions resulting from desilvering have been proposed.

A regeneration method in which a spent bleach-fix bath is contacted with metallic iron (steel wool) is disclosed in *Radiography*, Vol. 29, pp. 256–259 (1963) and JP-A-48-3624 (the term "JP-A" as used herein means an "unexamined published Japanese patent application"). According to this method, while silver ions contacted with metallic iron are recovered as metallic silver to reduce the silver ion concentration, metallic iron is dissolved into a bleach-fix bath as a strongly reducing iron (II) ion to weaken the oxidizing ability of the bath. As regeneration is repeated, metallic iron is dissolved to greatly vary the iron ion concentration, making it difficult to stably control the concentration. As the silver ion concentration is reduced, this problem becomes pronounced.

A method for reducing silver ions by electrolysis is described in JP-B-53-40491 (the term "JP-B" as used herein means an "examined Japanese patent publication"), JP-A-51-19535 (West German Patent 2534920), JP-A-51-36136, and U.S. Pat. No. 4,014,764. In this case, too, an iron (III) complex is reduced to an iron (II) complex or a sulfite ion is oxidized to a sulfate ion at the anode, which seriously fatigues the processing solution and, at the same time, reduces stability of the solution. This problem becomes more pronounced as the amount of electricity is increased to raise the rate of silver recovery and to reduce the silver ion concentration in the bleach-fix bath.

A technique for removing a silver complex by adsorption onto an ion exchange resin is proposed in *J. Appl. Photogr. Eng.*, Vol. 6, pp. 14–18 (1980). However, this method involves complicated operations for releasing an adsorbed silver complex from the resin to regenerate the resin. Besides, it produces a large quantity of a waste liquid and is unsatisfactory from the standpoint of running cost.

Thus, the conventional techniques for removing or reducing unnecessary components from a spent processing solution to make the solution reusable generally encounter difficulty in controlling the final ratio of the components or analyzing the components, involve complicated operations, and require large-sized equipment for regeneration.

JP-B-56-33697 (British Patent 1405948) and JP-A-50-145231 disclose a technique for regenerating an overflow, in which silver is not positively removed, but, when necessary, an equilibrium amount of accumulated silver ion is relatively reduced, for example, by dilution. This method is simple, easy, and inexpensive to carry out and requires no special equipment for silver recovery.

However, this method, when used alone, has causes delay in desilvering due to accumulation of silver bromide dissolved out in a large quantity and accumulation of a sulfate. Eventually, this method tends to cause undesirable stain due to accumulation of developer components or poor color reproduction, resulting from poor stability of running performance. When this method is utilized, particularly for reuse of a bleach-fix bath, halide ions accumulate and silver ions, an iron (II) aminopolycarboxylate accumulate and, in addition, developer components or a sulfate resulting from oxidation of a sulfite ion accumulates. It appears that these accumulated components act on each other in a complex fashion or act as a whole, and result in delay in desilvering, formation of a leuco cyan dye (which leads to poor color reproduction), deterioration of image preservability, and particularly thermal discoloration of a cyan dye. Such a phenomenon becomes more pronounced in rapid processing.

Therefore, development of a technique for regenerating an overflow generally is difficult and, above all, regeneration of a bleach-fix bath is very difficult because of the complicated action of the components contained or accumulated.

It has been suggested that addition of a water-soluble compound having an aldehyde group or a methylol group to a bleach-fix stabilizing bath makes rapid processing feasible and prevents yellow staining (which is believed ascribed chiefly to the action of formalin) as disclosed in JP-A-48-42733. Further, JP-A-50-51326

(U.S. Pat. No. 4,033,771) and JP-A-56-107244 (U.S. Pat. No. 4,033,771) describe that addition of a carbonyl bisulfite addition compound to a bleach-fix bath retards sulfiding of the bleach-fix bath and also prevents formation of a leuco cyan dye. However, in a regenerated system in which a spent bleach-fix bath is repeatedly reused, the influences of various accumulated components, are greater than expected as mentioned above, so that conventioned regeneration techniques for a bleach-fix bath cannot be simply applied. Moreover, the above-described conventional techniques do not solve the problems arising in the regeneration of a bleach-fix bath, such as delay in desilvering and deterioration of image preservability (particularly thermal discoloration of a cyan image).

SUMMARY OF THE INVENTION

An object of this invention is to provide a method for processing a silver halide color photographic material which does not cause desilvering trouble and will hardly deteriorate image preservation, even when the bleach-fixing solution, in which the spent solution (overflow) is added as a replenisher, is repeatedly used.

The inventors have now discovered that when a commonly employed sulfite is used as a preservative in regeneration of a spent bleach-fix bath, a sulfate resulting from oxidation of the sulfite ion is considerably accumulated as the regeneration and reuse are repeated to cause the above-described problems, such as deterioration of desilvering performance and image preservability. Where a sulfite is employed, it is considered that the above-described accumulation of a sulfate retards swelling of a light-sensitive material in a bleach-fix bath, resulting in such problems. Based on this discovery, it has now been found that the objects of the invention can be attained by using a compound which releases a sulfite when necessary, i.e., a carbonyl bisulfite adduct as a preservative of a regenerant used for regenerating a spent bleach-fix bath.

Accordingly, the present invention relates to a method for processing an exposed silver halide color photographic material comprising the steps of:

(a) color developing an exposed silver halide color photographic material;
(b) bleach-fixing said developed material;
(c) at least one of washing said bleach-fixed material with water and stabilizing said bleach-fixed material;
(d) regenerating a portion of a solution from said step (b) for bleach-fixing to form a replenisher solution comprising at least a carbonyl bisulfite adduct; and
(e) replenishing at least one solution in said bleach-fixing step (b) with said replenisher solution from step (d).

DETAILED DESCRIPTION OF THE INVENTION

It has now been found that sufficient desilvering performance and satisfactory image preservability can be assured even if a spent processing solution (overflow) is repeatedly reused as a regenerated replenisher by adding lacked components as a regenerant without need to positively remove or reduce unnecessary accumulated components (e.g., silver ions) from the overflow.

In the present invention, it is particularly preferable to improve a color reproduction in a regeneration method using carbonylsulfite adducts. That is, even when the overflow contains relatively large amount of eluted components and a component in the pre-bath, the method of the present invention provides unexpected excellent advantages. The cyan coupler represented by formula (C) below is advantageously used in the case where the regeneration rate is over 80%, preferably over 90%.

It has also been found that the above-mentioned image preservability of a silver halide color photographic material is greatly improved when the material contains at least one cyan coupler represented by formula (I):

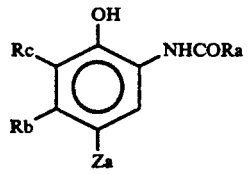

(I)

wherein Ra represents an alkyl group, a cycloalkyl group, an aryl group, an amino group, or a heterocyclic group having 1 to 32 carbon atoms; Rb represents an acylamino group or an alkyl group having 2 to 20 carbon atoms; Rc represents hydrogen, a halogen atom, an alkyl group, or an alkoxy group having 1 to 30 carbon atoms; Rc and Rb may be linked to form a ring; and Za represents hydrogen, a halogen atom, or a coupling-off group capable of being released upon coupling with an oxidation product of an aromatic primary amine color developing agent.

A color developing solution which can be used for development processing of light-sensitive materials preferably includes an alkaline aqueous solution containing an aromatic primary amine color developing agent as a main component. Useful color developing agents include aminophenol compounds and, preferably, p-phenylenediamine compounds. Typical examples of p-phenylenediamine developing agents are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and sulfates, hydrochlorides or p-toluenesulfonates thereof. If desired, these compounds may be used in combination of two or more thereof.

A color developing solution usually contains a pH buffer, e.g., alkali metal carbonates, borates or phosphates; and development inhibitors or antifoggants, e.g., bromides, iodides, benzimidazoles, benzothiazoles, and mercapto compounds. If desired, the color developing solution further contains various preservatives, e.g., hydroxylamine, diethylhydroxylamine, hydrazine sulfites, phenyl semicarbazides, triethanolamine, catecholsulfonic acids, and triethylenediamine(1,4-diazabicyclo[2,2,2]octane); organic solvents, e.g., ethylene glycol and diethylene glycol; development accelerators, e.g., benzyl alcohol, polyethylene glycol, quaternary ammonium salts, and amines; dye forming couplers; competing couplers; fogging agents, e.g., sodium borohydride; auxiliary developing agents, e.g., 1-phenyl-3-pyrazolidone; tackifiers; and various chelating agents, e.g., aminopolycarboxylic acids, aminopolyphosphonic acids, alkylphosphonic acids, and phosphonocarboxylic acids. Specific examples of the chelating agents are ethylenediaminetetraacetic acid, nitrilotriacetic acid, diethylenetriaminepentaacetic acid, cyclohexanediaminetetraaceticacid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

The color developing solution used in the present invention preferably contains substantially no benzyl alcohol. The term "substantially no benzyl alcohol" means that the benzyl alcohol content in a color developing solution is not more than 2 ml/l, and preferably zero.

Where reversal development is conducted, color development is generally preceded by black-and-white development. A black-and-white developing solution to be used contains one or more of known black-and-white developing agents, such as dihydroxybenzenes, e.g., hydroquinone; 3-pyrazolidones, e.g., 1-phenyl-3-pyrazolidone; and aminophenols, e.g., N-methyl-p-aminophenol.

The color developing solution and black-and-white developing solution generally have a pH of from 9 to 12. A rate of replenishment for these developing solutions is usually 3 l per $m^2$ of a light-sensitive material, though varying depending on the kind of the light-sensitive material. The replenishment rate may be reduced to 500 ml/$m^2$ or less or even to 150 ml/$m^2$ or less by reducing the bromide ion concentration or chloride ion concentration in the replenisher. In the case of reducing the replenishment rate, it is preferable to prevent evaporation or air oxidation of the replenisher by minimizing the liquid surface area of the processing tank in contact with air. Reduction of the replenishment rate may also be achieved by suppressing accumulation of bromide ion in the developing solution.

A development-processed photographic emulsion layer is usually subjected to bleaching. In the present invention, bleaching may be carried out simultaneously with fixing (bleach-fixing). Also included for desilvering are a method in which bleaching is followed by bleach-fixing, a method of using two bleach-fix baths in series, a method in which bleach-fixing is preceded by fixing, and a method in which bleach-fixing is followed by bleaching. A processing procedure for desilvering can be selected without limitation from these methods according to purpose but, in a preferred embodiment, a light-sensitive material is subjected to bleaching immediately after color development.

Suitable bleaching agents include compounds of polyvalent metals, e.g., iron (III), cobalt (III), chromium (VI), and copper (II), and peracids. Typical examples of these bleaching agents are complex salts of iron (III) or cobalt (III) with organic acids, e.g., aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid), citric acid, tartaric acid, and malic acid; and persulfates. From the standpoint of rapid processing and environmental pollution prevention, preferred bleaching agents are aminopolycarboxylic acid iron (III) complex salts, e.g., ethylenediaminetetraacetic acid iron (III) complex salts and diethylenetriaminepentaacetic acid iron (III) complex salts, persulfates, and hydrogen peroxide. Aminopolycarboxylic acid iron (III) complex salts are particularly useful. A bleach-fix bath containing these aminopolycarboxylic acid iron (III) complex salts usually has a pH of from 4.0 to 8. For rapid processing, a lower pH can be used. A pH of from 4.5 to 6.5 is particularly preferred.

If desired, the bleach-fix bath may contain a bleach accelerator. Specific examples of useful bleach-fix accelerators include compounds having a mercapto group or a disulfide linkage as described in U.S. Pat. No. 3,893,858, West German Patent 1,290,812, JP-A-53-95630, and *Research Disclosure*, No. 17129 (Jul., 1978); thiazolidine derivatives as described in JP-A-50-140129; thiourea derivatives as described in U.S. Pat. No. 3,706,561; iodides as described in JP-A-58-16235; polyoxyethylene compounds as described in West German Patent 2,748,430; polyamine compounds as described in JP-B-45-8836; and bromide ion. Preferred are compounds having a mercapto group or a disulfide linkage in view of their high accelerating effects. The compounds described in 3,893,858, West German Patent 1,290,812, and JP-A-53-95630 are particularly preferred. In addition, the compounds described in U.S. Pat. No. 4,552,834 are also preferred. These bleach accelerators may be incorporated into a light-sensitive material. The bleach accelerator is especially effective in bleach-fixing color light-sensitive materials for photographing.

Suitable fixing agents include thiosulfates, thiocyanates, thioether compounds, thioureas, and a large amount of iodides, with thiosulfates being generally employed. In particular, ammonium thiosulfate is the most widely used. Suitable preservatives for the bleach-fix bath include sulfites, bisulfites, sulfinates, and carbonyl bisulfite adducts, with carbonyl bisulfite adducts being particularly preferred.

If desired, buffers, fluorescent brightening agents, chelating agents, defoaming agents, and anti-fungus agents may be added to the bleach-fix bath.

In the present invention, a regenerant is incorporated into a spent bleach-fix bath (overflow) to obtain a regenerated bleach-fix replenisher for reuse.

Accumulated components (e.g., a silver ion) in the regenerated replenisher optionally may be removed or reduced by a known technique, such as a steel wool method as disclosed in JP-A-48-3624 and U.S. Pat. No. 4,065,313, an electrolysis method as described in JP-B-53-40491 and JP-A-61-232452, and a dilution method as described in JP-B-56-33697. A regenerated replenisher obtained by simply adding a regenerant without removing or reducing the accumulated components can be used in the present invention. For the sake of convenience, a method of preparing a regenerated replenisher simply by adding a regenerant without using the above-described operations for removal or reduction of a silver ion is preferred.

A regenerant is added to an overflow for the purpose of making up the components consumed by bleach-fix.

The regenerant which is used in the present invention contains a bleaching agent, a fixing agent, and a preservative which are, typically of the same kinds as used in the bleach-fix bath and, if desired, a bleach accelerator, a re-halogenating agent, a pH buffer. It is preferred for the regenerant to further contain a small amount of an acid.

In the present invention, a carbonyl bisulfite adduct is used as a preservative in the regenerant. A carbonyl compound which can be used in the regeneration system of the present invention preferably includes aliphatic carbonyl compounds having from 2 to 9 carbon atoms. Those having from 2 to 7 carbon atoms are particularly preferred. In using an aromatic carbonyl compound in the regeneration system of the present invention, those having a sulfo group, a carboxyl group, or a phospho group as a substituent group are preferred.

These carbonyl compounds are known to easily form an addition product with a bisulfite ion or a sulfite ion and are commercially available.

Specific examples of preferred carbonyl bisulfite adducts for use in the present invention include the following compounds inclusive of their salts, but the present invention is not to be construed as being limited thereto.

(1) Acetaldehyde bisulfite adduct
(2) Propionaldehyde bisulfite adduct
(3) n-Butylaldehyde bisulfite adduct
(4) iso-Butylaldehyde bisulfite adduct
(5) Glutaraldehyde bisbisulfite adduct
(6) Succinaldehyde bisbisulfite adduct
(7) Malonaldehyde bisbisulfite adduct
(8) Maleinaldehyde bisbisulfite adduct
(9) β-Methylglutaraldehyde bisbisulfite adduct
(10) Glycolaldehyde bisulfite adduct
(11) o-Sulfobenzaldehyde bisulfite adduct
(12) Salicylaldehyde bisulfite adduct
(13) m-Nitrobenzaldehyde bisulfite adduct
(14) L-Glyceraldehyde bisulfite adduct
(15) Chloroacetaldehyde bisulfite adduct
(16) Bromoacetaldehyde bisulfite adduct
(17) Acetone bisulfite adduct
(18) Dihydroxyacetone bisulfite adduct
(19) Hydroxyacetone bisulfite adduct
(20) Pyruvic acid bisulfite adduct
(21) N-Acetylaminoacetic acid bisulfite adduct
(22) 3-Acetylpropionic acid bisulfite adduct
(23) 4-Acetylpropanol bisulfite adduct
(24) 4-Acetylbutyric acid bisulfite adduct
(25) Ethyl methylacetacetate bisulfite adduct
(26) Nicotinaldehyde bisulfite adduct
(27) Methyl ethyl ketone bisulfite adduct
(28) Acetylacetone bisulfite adduct
(29) Ethyl ethylacetacetate bisulfite adduct Preferred are compounds (1), (2), (5), (6), (11), (12), (13), (19), and (26). These compounds may be added to a bleach-fix bath or a fixing bath either as separate carbonyl compound and bisulfite or sulfite, or in the form of the above-described bisulfite adduct.

The carbonyl compound bisulfite adduct to be added to a regenerant preferably has a carbonyl compound to bisulfite or sulfite molar ratio of from 5:1 to 1:10, and more preferably from 1:1 to 1:5.

The amount of the carbonyl compound bisulfite adduct to be added to a regenerant preferably ranges from 0.01 to 1 mol, and more preferably from 0.01 to 0.3 mol, per liter of a regenerated bleach-fix replenisher solution (overflow).

Any of the above-described carbonyl compound bisulfite adducts is commercially sold and easily available.

The acid which is preferably added to a regenerant may be any of organic acids and inorganic acids, but among them, hydrochloric acid, nitric acid, or acetic acid is preferred. The acid is preferably added in an amount of from 1 to 30 g per liter of a regenerated replenisher (overflow), and more preferably in such an amount that the resulting regenerated replenisher may have a pH between 4.0 and 6.0.

The content of the bleaching agent in the regenerant preferably ranges from 0.1 to 50 g, and more preferably from 1 to 30 g, per liter of the regenerated replenisher solution (overflow).

Likewise, the fixing agent content preferably ranges from 2 to 50 g/l, and more preferably from 5 to 30 g/l; and a preservative content preferably ranges from 5 to 50 g/l, and more preferably from 10 to 30 g/l, of regenerated replenisher (overflow).

The regenerant is usually added to a spent bleach-fix bath (overflow) collected in a tank, when the amount of the overflow reaches a given level to prepare a replenisher. The overflow can be reused a number of times. If necessary, after the elapse of a certain period of time, accumulated components may be removed by the above-described known methods.

According to the method of the present invention in which carbonyl bisulfite addition compounds are used as a regenerant, a deterioration of the image preservability and desilverization property can be protected under the usual regeneration rate (50 to 70%) and an excellent treatment of the developed photographic material with a high regeneration rate of the overflow can be attained.

That is, the method of the present invention is highly desirable in such a system that the amount of accumulated components increases, such as eluted components from the photographic material and carried over components of the developing agent from the pre-bath, when the regeneration rate is increased.

The regeneration rate used herein is defined according to the following equations.

$$\text{Regeneration (\%)} = \frac{\text{An amount of reused overflow}}{\text{An amount of overflow}} \times 100$$

Further, the method of .the present invention is advantageously utilized when the regeneration is over 80%, preferably over 90%. In an automatic development machine, the method of the present invention greatly reduces the amount of waste solution.

A suitable rate of replenishment to the bleach-fixing solution, i.e., the amount of replenished overflow, solution added to the bleach-fixing bath is from 30 to 500 ml, and preferably from 60 to 250 ml, per $m^2$ of a light-sensitive material.

Since the effects of the present invention become pronounced as the processing rate is increased, bleach-fixing is preferably performed at a temperature of from 20 to 50° C., and more preferably from 30 to 40° C., for a processing time of from 20 seconds to 3 minutes, and more preferably from 30 seconds to 1 minute.

The silver halide color photographic materials having been subjected to desilvering are generally subjected to at least one of washing and stabilization. The amount of washing water to be used in the washing step is selected from a broad range depending on the characteristics of the light-sensitive materials (e.g., the kind of photographic materials such as couplers), the end use of light-sensitive materials, the temperature of washing water, the number of washing tanks (the number of stages), the replenishing system (e.g., counter-flow system or direct-flow system), and other various conditions. For example, the relation between the number of washing tanks and the quantity of water in a multi-stage counter-flow system can be obtained by the method described in *Journal of the Society of Motion Picture and Television Engineers*, Vol. 64, pp. 248–253 (May, 1955).

According to the multi-stage counter-flow system described in the above-cited article, although the requisite amount of water can be greatly reduced, there is a tendency for bacteria to grow in the tank as the water retention time is increased, and the suspended bacterial cells adhere to light-sensitive materials. In the present invention, such a problem can be effectively eliminated by reducing calcium and magnesium ion in the washing water as described in JP-A-62-288838. It is also possible to use bactericides, such as isothiazolone compounds or thiabendazoles described in JP-A-57-8542, chlorine type bactericides, e.g., chlorinated sodium isocyanurate, benzotriazoles, and other bactericides described in Hiroshi Horiguchi, *Bokin bobaizai no kagaku,* Eisei Gijutsukai (ed.), *Biseibutsu no mekkin, sakkin, bobai gijutsu,* and Nippon Bokin Bobai Gakkai (ed.), *Bokin bobaizai jiten.*

Washing water used in the washing step has a pH between 4 and 9, and preferably between 5 and 8. Washing is usually carried out at a water temperature of from 15 to 45° C. for a period of from 20 seconds to 10 minutes, and preferably at a temperature of from 25 to 40° C. for 30 seconds to 2 minutes, though widely varying depending on characteristics of a light-sensitive material, the end use of a light-sensitive material, and the like.

The above-described washing step may be replaced by stabilization processing. Any known method of stabilization processing, such as the methods described in JP-A-57-8543, JP-A-58-14834, and JP-A-60-220345, can be used.

The washing step may be followed by stabilization processing. Examples of stabilizing baths used include a stabilizing bath containing formalin and a surface active agent which is used as a final bath for processing color light-sensitive materials for photographing. The stabilizing bath may further contain various chelating agents and anti-fungal agents.

The overflow resulting from replenishment of washing water and/or stabilizing solution may be utilized for other processing steps, such as desilvering.

For the purpose of simplification and speeding up of processing, the silver halide color light-sensitive material of the present invention may contain a color developing agent. In this case, the color developing agent is preferably added in the form of a precursor thereof. Examples of suitable color developing agent precursors include indoaniline compounds described in U.S. Pat. No. 3,342,597; Schiff base type compounds described in U.S. Pat. No. 3,342,599 and *Research Disclosure,* Nos. 14850 and 15159; aldol compounds described in *Research Disclosure,* No. 13924; metal complexes described in U.S. Pat. No. 3,719,492; and urethane compounds described in JP-A-53-135628.

If desired, the silver halide color photographic materials may contain various 1-phenyl-3-pyrazolidone compounds for the purpose of accelerating color development. Typical examples of useful 1-phenyl-3-pyrazolidone compounds are described in JP-A-56-64339, JP-A-57-144547, and JP-A-58-115438.

Each processing solution in the present invention is used at a temperature of from 10 to 50° C., and usually from 33 to 38° C. Higher temperatures can be used to accelerate processing and to shorten the processing time, or lower temperatures can be used to improve image quality or stability of the processing solution.

The processing method according to the present invention is applicable to any type of processing as long as a color developing solution is used. For example, it is applicable to processing, for example, of color paper, color reversal paper, color positive films, color negative films, color reversal films, and color direct positive light-sensitive materials. Application to color paper, color reversal paper, and auto-positive paper is suitable.

In the silver halide color photographic materials according to the present invention, the silver halide emulsions may have any halogen composition, such as silver iodobromide, silver bromide, silver chlorobromide, and silver chloride.

Where rapid processing or low-replenishment processing is conducted, a silver chlorobromide emulsion having a silver chloride content of at least 60 mol %, particularly from 80 to 100 mol % (i.e., a silver chloride emulsion), is preferred. Where high photographic speed is demanded while particularly limiting fog during preparation, preservation and/or processing of a light-sensitive material, a silver bromide emulsion or a silver chlorobromide emulsion having a silver bromide content of at least 50 mol %, and particularly at least 70 mol %, is preferably used. If the silver bromide content exceeds 90 mol %, rapid processing is difficult. However, by accelerating development, for example, using a silver halide solvent, a fogging agent, or a development accelerator, the rate of development can be increased to some extent irrespective of the silver bromide content. Thus, the silver halide emulsions having a silver bromide content exceeding 90 mol % are sometimes preferred. In any case, a high silver iodide content is not preferred and is suitably not more than 3 mol %. These silver halide emulsions are preferably used in light-sensitive materials for printing, such as color paper.

For color light-sensitive materials for photographing, such as negative films and reversal films, silver iodobromide or silver chloroiodobromide emulsions, preferably those having a silver iodide content of from 3 to 15 mol %, are preferred.

The rapid processing discussed above is referred to, for example, in WO 87/04534.

Silver halide grains which can be used in the present invention may have a heterogeneous structure differing between the inside and the outer layer (core/shell grains), a multi-phase structure having an epitaxially fused structure, a homogeneous structure, or a mixed structure thereof.

The mean grain size of silver halide grains is preferably from 0.1 to 2 μm, and more preferably from 0.15 to 1.5 μm. The terminology "mean grain size" as used herein means the average diameter of spherical or nearly spherical grains or the side length of cubic grains, calculated based on the projected area. The mean grain size of tabular grains is calculated from a sphere-equivalent diameter. Grain size distribution may be either narrow or broad. In particular, a mono-dispersed silver halide emulsion, whose grain size variation coefficient (a quotient obtained by dividing a standard deviation of a size distribution curve by the mean grain size) falls within 20%, and particularly within 15%, is preferred.

To meet a desired gradation, two or more mono-dispersed silver halide emulsions differing in grain size, whose coefficient of variation is preferably within the above-recited range, may be incorporated into the same emulsion layer or separate layers having substantially the same color sensitivity. Further, a combination of two or more poly-dispersed emulsions or a combination of a mono-dispersed emulsion and a poly-dispersed emulsion may be used as a mixture thereof in the same layer or separately incorporated in different layers.

The silver halide grains used are not limited in shape and may have a regular crystal form, such as a cubic form, an octahedral form, a rhombic dodecahedral form, and a tetradecahedral form, or a mixture thereof; or an irregular crystal form, such as a spherical form; or a composite form thereof. An emulsion containing tabular grains, particularly an emulsion in which at least 50% of the total grains based on the total projected area are tabular grains having an aspect ratio of 5 or more, and preferably 8 or more, can be used as well. Emulsions containing a mixture of these various crystal forms may also be used. These emulsions may be either of a surface latent image type which forms a latent image predominantly on the grain surface or of a internal latent image type which forms a latent image predominantly in the inside of grains.

The photographic emulsions used in the present invention can be prepared by the process described in *Research Disclosure,* Vol. 176, Item No. 17643 (I, II, III) (Dec., 1978). Silver coverage is preferably not more than 0.80 g/m$^2$, and more preferably between 0.40 g/m$^2$ and 0.60 g/m$^2$.

Emulsions are generally subjected to physical ripening, chemical ripening, and spectral sensitization before use. Photographic additives which can be used in these steps are described in *Research Disclosure* (RD), Vol. 176, No. 17643 (Dec., 1978) and ibid, Vol. 187, No. 18716 (Nov., 1979) as listed below.

Other photographic additives which can be used in the present invention are also described in these publications as listed below.

| Additive | RD 17643 | RD 18716 |
|---|---|---|
| 1. Chemical Sensitizer | p. 23 | p. 648, right column (RC) |
| 2. Sensitivity Increasing Agent | | p. 648, right column (RC) |
| 3. Spectral Sensitizer | pp. 23–24 | p. 648, RC to p. 649, RC |
| 4. Supersensitizer | " | |
| 5. Brightening Agent | p. 24 | |
| 6. Antifoggant and Stabilizer | pp. 24–25 | p. 649, RC |
| 7. Coupler | p. 25 | " |
| 8. Organic Solvent | " | " |
| 9. Light Absorber, Filter Dye | pp. 25–26 | p. 649, RC to P. 650, left column (LC) |
| 10. Ultraviolet Absorber | " | P. 649, RC to P. 650, left column (LC) |
| 11. Stain Inhibitor | p. 25, RC | P. 650, LC to RC |
| 12. Dye Image Stabilizer | p. 25 | " |
| 13. Hardening Agent | p. 26 | p. 651, LC |
| 14. Binder | p. 26 | " |
| 15. Plasticizer, Lubricant | p. 27 | P. 650, RC |
| 16. Coating Aid, Surface Active Agent | pp. 26–27 | " |
| 17. Antistatic Agent | p. 27 | " |

Various color couplers can be used in the present invention. The term "color couplers" as used herein means compounds capable of undergoing a coupling reaction with an oxidation product of an aromatic primary amine developing agent to form a dye. Typical examples of useful color couplers include naphthol or phenol compounds, pyrazolone or pyrazoloazole compounds, and open-chain or heterocyclic ketomethylene compounds. Specific examples of these cyan, magenta, and yellow couplers which can be used in this invention are described in patents cited in *Research Disclosure,* No. 17632, VII-D (Dec., 1978).

Color couplers which are incorporated into a light-sensitive material preferably have a ballast group or have a polymeric form and are thereby nondiffusible. From the standpoint of saving silver, 2-equivalent couplers having the coupling position thereof substituted with a group releasable on coupling are preferred to 4-equivalent couplers whose coupling position has halogen. In addition, couplers producing a dye having moderate diffusibility, colorless couplers, DIR couplers capable of releasing a development inhibitor on coupling, or couplers capable of releasing a development accelerator on coupling can also be used.

Suitable yellow couplers which can be used in the present invention typically include oil-protected type acylacetamide couplers. Specific examples of these couplers are given in U.S. Pat. Nos. 2,407,210, 2,875,507, and 3,265,506. Two-equivalent yellow couplers are preferred as mentioned above. Included in these dyes are yellow couplers of oxygen-release type as described in U.S. Pat. Nos. 3,408,194, 3,447,928, 3,933,501, and 4,022,620; and nitrogen-release type yellow couplers as described in JP-B-55-10739, U.S. Pat. Nos. 4,401,752 and 4,326,024, *Research Disclosure* 18053 (Apr., 1979), British Patent 1,425,020, and West German Patent OLS Nos. 2,219,917, 2,261,361, 2,329,587, and 2,433,812. In particular, α-pivaloylacetanilide couplers produce dyes having excellent fastness, especially to light, and α-benzoylacetanilide couplers produce dyes having high color density.

Suitable magenta couplers which can be used in this invention include oil-protected type indazolone or cyanoacetyl couplers, preferably 5-pyrazolone couplers and pyrazoloazole couplers such as pyrazolotriazoles. The 5-pyrazolone couplers preferably have the 3-position thereof substituted with an arylamino group or an acylamino group in view of the hue or density of a developed color. Typical examples of such 5-pyrazolone couplers are described in U.S. Pat. Nos. 2,311,082, 2,343,703, 2,600,788, 2,908,573, 3,062,653, 3,152,896, and 3,936,015. Releasable groups of the 2-equivalent 5-pyrazolone couplers preferably include nitrogen-releasable groups as described in U.S. Pat. No. 4,310,619 and arylthio groups as described in U.S. Pat. No. 4,351,897. Further, 5-pyrazolone couplers having a ballast group as described in European Patent 73,636 produce high color densities.

Suitable pyrazoloazole couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* 24220 (Jun., 1984), and pyrazolopyrazoles as described in *Research Disclosure,* 24230 (Jun., 1984). From the standpoint of reduction in undesired yellow absorption and light fastness of a developed color, imidazo[1,2-b]pyrazoles as described in European Patent 119,741 are preferred, and pyrazolo[1,5-b][1,2,4]triazole described in European Patent 119,860 is particularly preferred.

Cyan couplers which can be used in this invention include oil-protected type naphthol and phenol couplers. Typical examples of these cyan couplers are naphthol couplers described in U.S. Pat. No. 2,474,293, and preferably oxygen-release type 2-equivalent naphthol couplers as described in U.S. Pat. Nos. 4,052,212, 4,146,396, 4,228,233, and 4,296,200. Examples of phenol couplers are described in U.S. Pat. Nos. 2,369,929, 2,801,171, 2,772,162, and 2,895,826. Cyan couplers stable to moisture and heat are preferably used in the present invention. Typical examples of such couplers include phenol cyan couplers having an alkyl group having at least two carbon atoms at the m-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent (OLS) No. 3,329,729, and JP-A-59-166956, and phenol couplers having a phenylureido group at the 2-position and an acylamino group at the 5-position as described in U.S. Pat. Nos. 3,446,622, 4,333,999, 4,451,559, and 4,427,767.

In the present invention, it is particularly preferred to use a cyan coupler represented by formula (I):

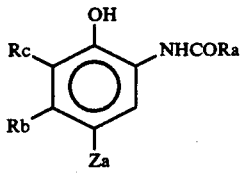

(I)

wherein Ra represents an alkyl group, a cycloalkyl group, an aryl group, an amino group, or a heterocyclic group having 1 to 32 carbons; Rb represents an acylamino group or an alkyl group having 2 or more carbon atoms; Rc represents hydrogen, a halogen atom, an alkyl group, or an alkoxy group having 1 to 30 carbons; Rc and Rb may be linked to form a ring; and Za represents hydrogen, a halogen atom, or a coupling-off group releasable on reacting with an oxidation product of an aromatic primary amine color developing agent (hereinafter referred to as a "coupling-off" group).

Use of the cyan coupler of formula (I) provides improved color reproducibility in the process according to the invention.

In formula (I), the alkyl group represented by Ra preferably includes those having from 1 to 32 carbon atoms, e.g., methyl, butyl, tridecyl, cyclohexyl, and allyl groups. The aryl group represented by Ra includes phenyl and naphthyl groups. The heterocyclic group represented by Ra includes 2-pyridyl and 2-furyl groups. The amino group represented by Ra preferably includes substituted or unsubstituted phenylamino groups.

These substituent groups represented by Ra may have a substituent selected from an alkyl group, an aryl group, an alkyl- or aryloxy group (e.g., methoxy, dodecyloxy, methoxyethoxy, phenyloxy, 2,4-di-t-amylphenoxy, 3-t-butyl-4-hydroxyphenyloxy, naphthyloxy), a carboxyl group, an alkyl- or arylcarbonyl group (e.g., acetyl, tetradecanoyl, benzoyl), an alkyl- or aryloxycarbonyl group (e.g., methoxycarbonyl, phenoxycarbonyl), an acyloxy group (e.g., acetyl, benzoyloxy), a sulfamoyl group (e.g., N-ethylsulfamoyl, N-octadecylsulfamoyl), a carbamoyl group (e.g., N-ethylcarbamoyl, N-methyl-dodecylcarbamoyl), a sulfonamido group (e.g., methanesulfonamido, benzenesulfonamido), an acylamino group (e.g., acetylamino, benzamido, ethoxycarbonylamino, phenylaminocarbonylamino), an imido group (e.g., succinimido, hydantoinyl), a sulfonyl group (e.g., methanesulfonyl), a hydroxyl group, a cyano group, a nitro group, and a halogen atom.

In formula (c), Rb represents, as an acylamino group, for example, a dichloroacetyl and a heptafluorobutylylamino group; as an alkyl group having 2 or more carbon atoms, an ethyl, propyl, butyl, pentadecyl, tertbutyl, phenylthioethyl, and methoxyethyl group; and preferably is an alkyl group having 2 to 15 carbon atoms, most preferably alkyl group having 2 to 4 carbon atoms.

Further, in formula (c), Rc represents as a halogen atom, form example, a chlorine, bromine, and fluorine atom; as alkyl group, a methyl, ethyl, propyl, butyl, pentadecyl, tertbutyl, cychlohexylmethyl, phenylthiomethyl, dodecyloxyphenylthiomethyl, butaneamidomethyl, and methoxymethyl; and, as an alkoxyl group, an ethoxy, dodecyloxy, methoxyethylcarbamoylmethoxy, 3-(methane sulfoneamide)propyloxy, carboxypropyloxy, and methylsulfonylethoxy group; and preferably is a hydrogen and halogen atom, most preferably a chlorine and fluorine atom.

In formula (I), Za represents hydrogen or a coupling-off group. Examples of the coupling-off group include a halogen atom (e.g., fluorine, chlorine, bromine), an alkoxy group (e.g., dodecyloxy, methoxycarbamoylmethoxy, carboxypropyloxy, methylsulfonylethoxy), an aryloxy group (e.g., 4-chlorophenoxy, 4-methoxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamin, methanesulfonylamino, toluenesulfonylamino), an alkoxycarbonyloxy group (e.g., ethoxycarbonyloxy, benzyloxycarbonyloxy),anaryloxycarbonyloxy group (e.g., phenoxycarbonyloxy), an aliphatic or aromatic thio group (e.g., phenylthio, tetrazolylthio), an imido group (e.g., succinimido, hydantoinyl), a nitrogen-containing heterocyclic group (e.g., 1-pyrazoly, 1-benzotriazolyl), and an aromatic azo group (e.g., phenylazo). These releasable groups may contain a photographically useful group.

The compound represented by formula (I) may be a polymer, inclusive of a dimer, formed at Ra or Rb.

Specific examples of the cyan couplers of formula (I) are shown below, but the present invention is not to be construed as being limited thereto.

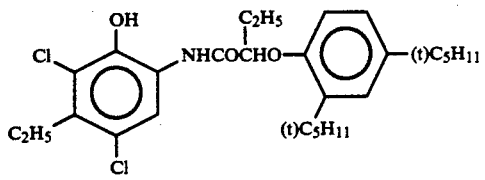

(C-1)

-continued
(C-2)
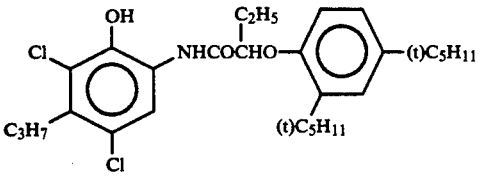
(C-3)
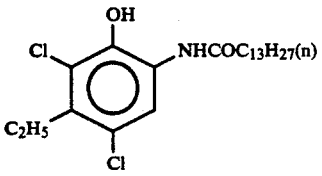
(C-4)
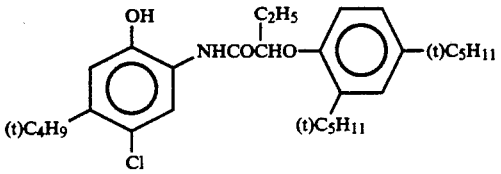
(C-5)
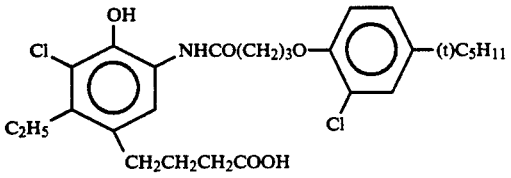
(C-6)
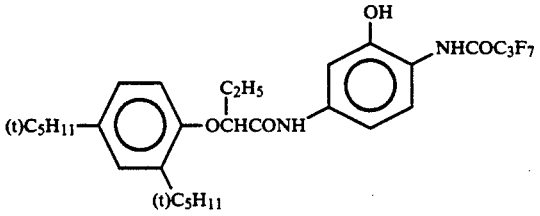
(C-7)
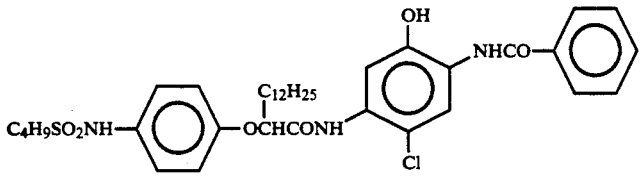
(C-8)
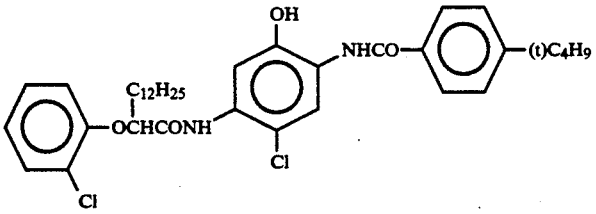
(C-9)
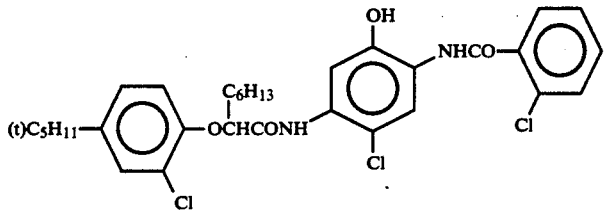

-continued
(C-10)
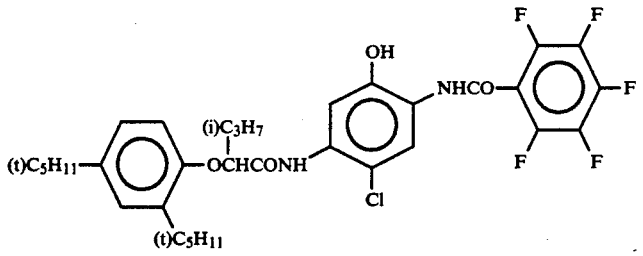
(C-11)
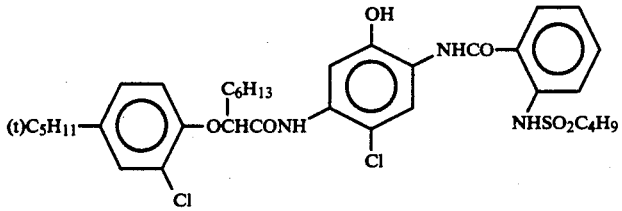
(C-12)
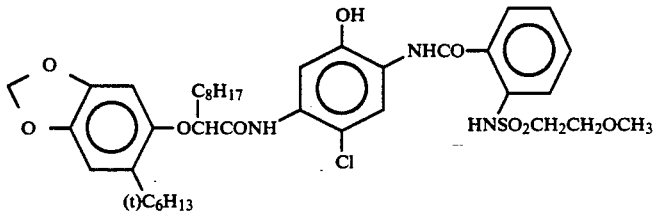
(C-13)
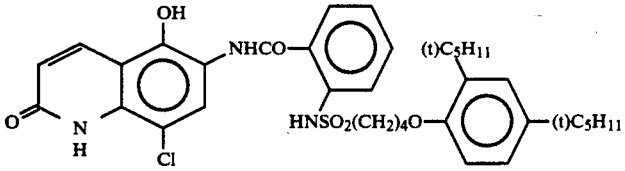
(C-14)
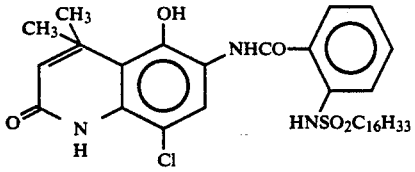
(C-15)
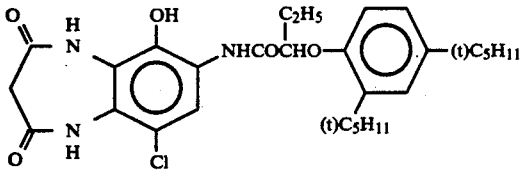
(C-16)
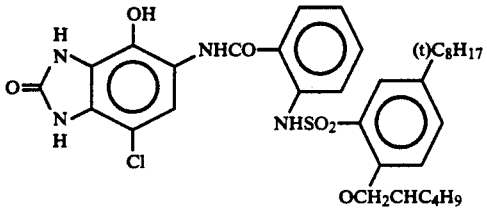

-continued
(C-17)
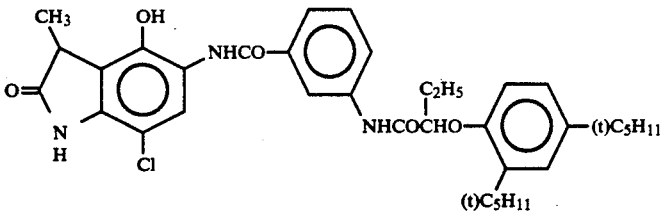
(C-18)
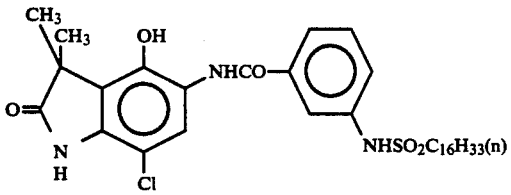
(C-19)
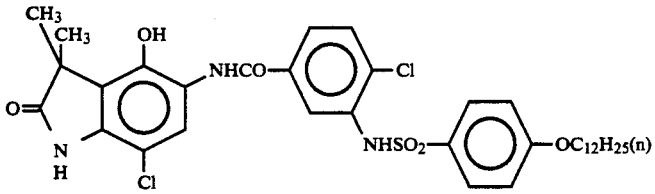
(C-20)
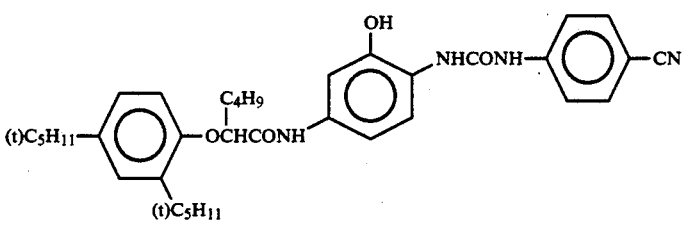
(C-21)
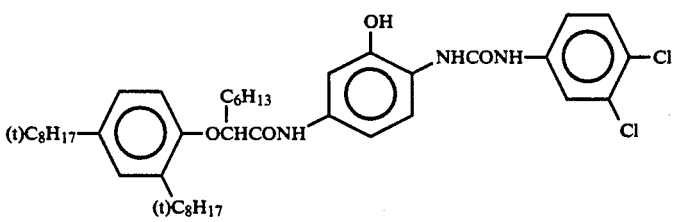
(C-22)
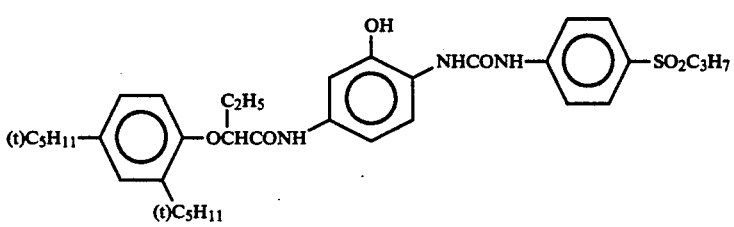
(C-23)
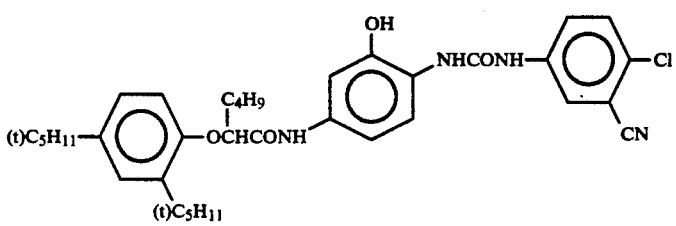

-continued (C-24)

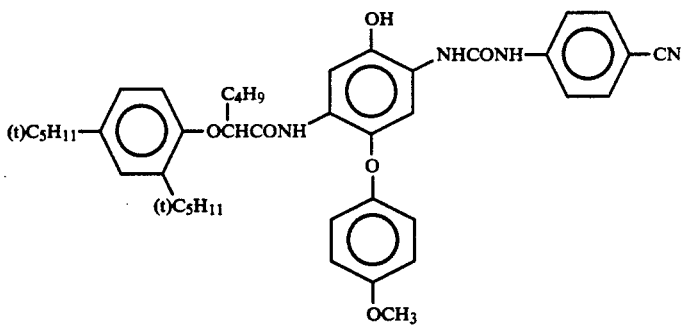

(C-25)

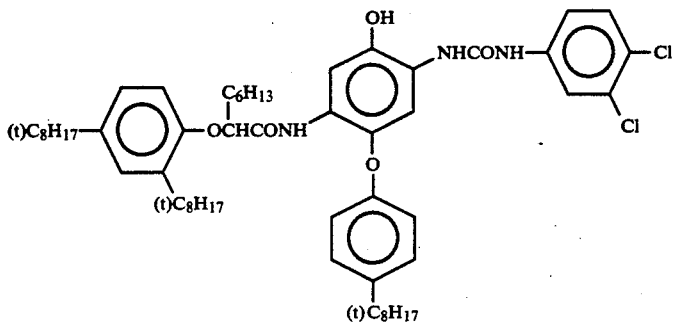

(C-26)

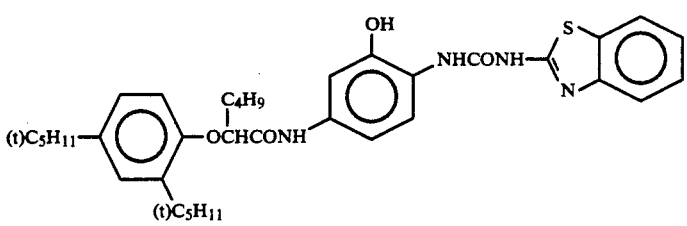

The cyan couplers of formula (I) can be synthesized according to, for example, the methods disclosed in JP-A-59-166956 and JP-B-49-11572.

The amount of the above-described cyan coupler is not particularly limited, but preferably ranges from $1\times10^{-4}$ to $1\times10^{-2}$ mol, and more preferably from $1\times10^{-5}$to $1\times10^{-5}$ mol, per $m^2$ of a light-sensitive material.

The combined use of a coupler which produces a dye having moderate diffusibility improves graininess. Examples of such a coupler include magenta couplers described in U.S. Pat. No. 4,366,237 and British Patent 2,125,570 and yellow, magenta or cyan couplers described in European Patent 96,570 and West German Patent OLS No. 3,234,533.

Dye-forming couplers and special couplers as stated above may be in the form of a polymer, inclusive of a dimer. Typical examples of dye-forming couplers in a polymer form are illustrated in U.S. Pat. Nos. 3,451,820 and 4,080,211. Magenta couplers in a polymer form are described in British Patent 2,102,173 and U.S. Pat. No. 4,367,282.

For the purpose of satisfying various characteristics required for light-sensitive materials, the above-described various couplers may be used as a mixture of two or more thereof in one light-sensitive layer or each of them may be introduced into two or more light-sensitive layers.

The couplers can be introduced into a light-sensitive material by various known dispersion techniques. Examples of high-boiling organic solvents which can be used in an oil-in-water dispersion method are described in, e.g., U.S. Pat. Nos. 2,322,027. Steps, effects, and specific examples of impregnating latices with respect to a latex dispersion method, one of polymer dispersion techniques, are described in U.S. Pat. No. 4,199,363 and West German Patent Application (OLS) Nos. 2,541,274 and 2,541,230. A dispersion method using an organic solvent-soluble polymer is described in PCT Application No. JP87/00492.

Examples of organic solvents which can be used in the above-mentioned oil-in-water dispersion method include alkyl phthalates (e.g., dibutyl phthalate, dioctyl phthalate), phosphoric esters (e.g., diphenyl phosphate, triphenyl phosphate, tricresyl phosphate, dioctylbutyl phosphate), citric esters (e.g., acetyl tributyl citrate), benzoic esters (e.g., octyl benzoate), alkylamides (e.g., diethyllaurylamide), fatty acid esters (e.g., dibutoxyethyl succinate, diethyl azelate), and trimesic esters (e.g., tributyl trimesate). Organic solvents having a boiling point of from 30° to 150° C., such as a lower alkyl acetate (e.g., ethyl acetate, butyl acetate), ethyl propionate, sec-butyl alcohol, methyl isobutyl ketone, $\beta$-ethoxyethyl acetate, and methyl cellosolve, may be used in combination.

Standard amounts of color couplers used range from 0.001 to 1 mol per mol of light-sensitive silver halide. In more detail, yellow couplers are used in an amount of from 0.01 to 0.5 mol; magenta couplers are used in an amount of from 0.003 to 0.3 mol; and cyan couplers are used in an amount of from 0.002 to 0.3 mol, each per mol of light-sensitive silver halide.

Finished emulsions or other coating compositions are coated on an appropriate support commonly employed in the art, including a flexible support, e.g., a film of synthetic resins (e.g., cellulose nitrate, cellulose acetate, polyethylene terephthalate) and paper, and a rigid support, e.g., a glass sheet. With respect to useful supports and coating methods, reference can be made in *Research Disclosure,* Vol. 176, Item 17643 XV (p. 27), XVIII (p. 28) (Dec., 1978).

In the present invention, a reflective support is preferably used. The terminology "reflective support" means a support having increased reflection properties to make a dye image formed in silver halide emulsion layers clearer. Included in such a reflective support are a support coated with a hydrophobic resin having dispersed therein a light-reflecting substance, e.g., titanium oxide, zinc oxide, calcium carbonate, and calcium sulfate, and a support containing a hydrophobic resin having dispersed therein the above-mentioned light-reflecting substance.

EXAMPLES

The present invention is now illustrated in greater detail with reference to specific Examples, but the present invention is not to be construed as being limited thereto. Unless otherwise indicated, all parts, percents and ratios are by weight.

EXAMPLE 1

Layers shown below were coated on a polyethylene-laminated (on both sides) paper support in the order listed to prepare a multi-layer color paper. Coating compositions were prepared as follows.

Preparation of 1st Layer Coating Composition

To a mixture of 19.1 g of a yellow coupler (ExY), 4.4 g of a dye image stabilizer (Cpd-1), and 0.7 g of a dye image stabilizer (Cpd-7) were added 27.2 ml of ethyl acetate and 8.2 g of a solvent (Solv-1) to form a solution. The resulting solution was emulsified and dispersed in 185 ml of a 10% gelatin aqueous solution containing 8 ml of 10% sodium dodecylbenzenesulfonate.

Separately, a cubic silver chlorobromide emulsion having a mean grain size of 0.88 μm and a variation coefficient of size distribution of 0.08 (hereinafter referred to as a "larger size" emulsion) and a cubic silver chlorobromide emulsion having a mean grain size of 0.70 μm and a variation coefficient of 0.10 (hereinafter referred to as a "smaller size" emulsion), both of which contained 0.2 mol % of silver bromide on the limited part of the grain surface, were mixed at an Ag molar ratio of 3:7. Each of blue-sensitive sensitizing dyes shown below was added to the larger size emulsion in an amount of $2.0\times10^{-4}$ mol/mol-Ag and to the smaller size emulsion in an amount of $2.5\times10^{-4}$ mol/mol-Ag. The emulsion was then subjected to sulfur sensitization.

The above-prepared coupler dispersion and the finished emulsion were mixed to prepare a 1st layer coating composition having the formulation shown below.

Coating compositions for the 2nd to 7th layers were also prepared in the same manner as for the 1st layer coating composition.

To each coating composition, 1-hydroxy-3,5-dichloro-s-triazine sodium salt was added as a gelatin hardening agent.

The spectral sensitizing dyes used in each light-sensitive layer and their amounts are shown below.

Blue-Sensitive Layer:

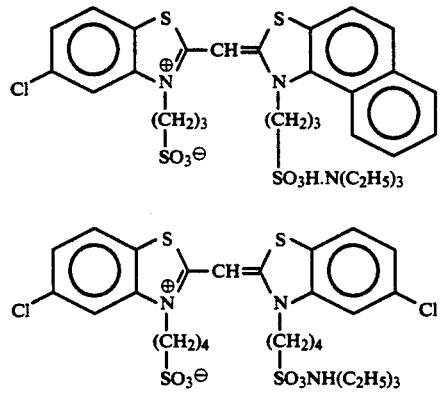

each in an amount of: $2.0\times10^{-4}$ mol/mol-AgX (X: halogen) in the larger size emulsion and $2.5\times10^{-4}$ mol/mol-AgX in the smaller size emulsion Green-Sensitive Layer:

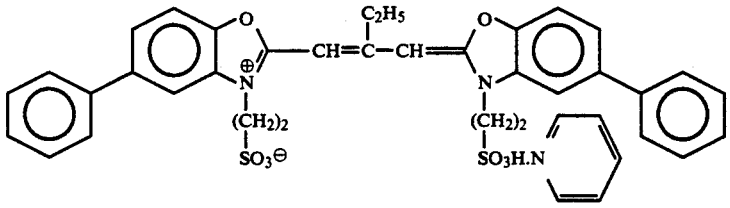

$4.0\times10^{-4}$ mol/mol-AgX in the larger size emulsion
$5.6\times10^{-4}$ mol/mol-AgX in the smaller size emulsion

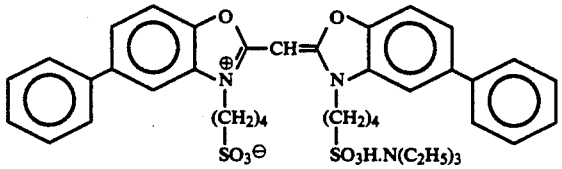

$7.0\times10^{-5}$ mol/mol-AgX in the larger size emulsion
$1.0\times10^{-5}$ mol/mol-AgX in the smaller size emulsion Red-Sensitive Emulsion Layer:

-continued

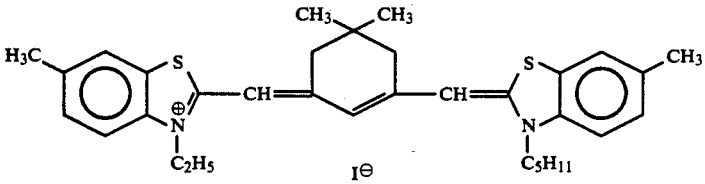

$0.9\times10^{-4}$ mol/mol-AgX i the larger size emulsion $1.1\times10^{-4}$ mol/mol-AgX in the smaller size emulsion To the coating composition for a red-sensitive emulsion layer was added the compound shown below in an amount of $2.6\times10^{-3}$ mol/mol-AgX.

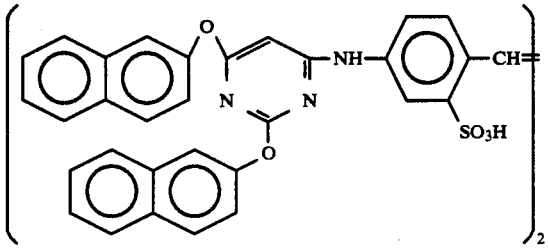

To each of the coating compositions for blue-, green- and red-sensitive emulsion layers was added 1-(5-methylureidophenyl)-5-mercaptotetrazole in an amount of $8.5\times10^{-5}$ mol, $7.7\times10^{-4}$ mol, and $2.5\times10^{-4}$ mol, respectively, per mol of AgX.

To each of the coating compositions for blue- and green-sensitive emulsion layers was added 4-hydroxy-6-methyl-1,3,3a,7-tetraazaindene in an amount of $1\times10^{-4}$ mol and $2\times10^{-4}$ mol, respectively, per mol of AgX.

For the purpose of preventing irradiation, the following dyes were added to the emulsion layers in an amount of 4 mg/m$^2$ for the former and 8 mg/m$^2$ for the latter.

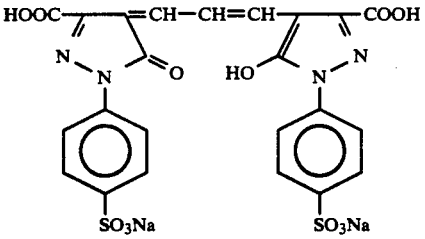

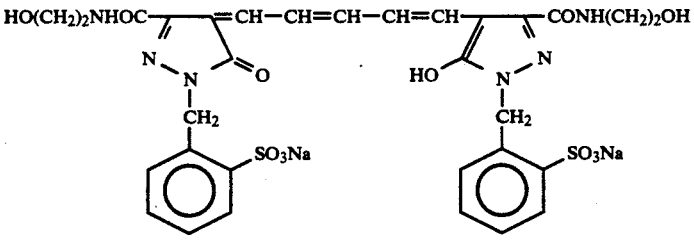

The layer structure of the multi-layer color paper is shown below. The amount of the silver halide emulsion is in terms of silver coverage (g/m$^2$).

LAYER STRUCTURE

Support

Polyethylene-laminated paper, the polyethylene layer on the size coated with a 1st layer contained a white pigment ($TiO_2$) and a bluing dye (ultramarine).

| | Amount (g/m$^2$) |
|---|---|
| 1st Layer (Blue-Sensitive Layer): | |
| The above-described silver chlorobromide emulsion | 0.30 |
| Gelatin | 1.86 |
| Yellow coupler (ExY) | 0.82 |
| Dye image stabilizer (Cpd-1) | 0.19 |
| Solvent (Solv-1) | 0.35 |
| Dye image stabilizer (Cpd-7) | 0.06 |
| 2nd Layer (Color Mixing Preventive Layer): | |
| Gelatin | 0.99 |
| Color mixing inhibitor (Cpd-5) | 0.08 |
| Solvent (Solv-1) | 0.16 |
| Solvent (Solv-4) | 0.08 |
| 3rd Layer (Green-Sensitive Layer): | |
| Silver chlorobromide emulsion (cubic grains; a 1:3 (by Ag mol) mixture of an emulsion having a mean grain size of 0.55 μm and a size variation coefficient of 0.10 and an emulsion having a mean grain size of 0.39 μm and a size variation coefficient of 0.08, both emulsions containing 0.8 mol % of AgBr on the limited part of the grain surface) | 0.12 |
| Gelatin | 1.24 |
| Magenta coupler (ExM) | 0.20 |
| Dye image stabilizer (Cpd-2) | 0.03 |
| Dye image stabilizer (Cpd-3) | 0.15 |
| Dye image stabilizer (Cpd-4) | 0.02 |
| Dye image stabilizer (Cpd-9) | 0.02 |
| Solvent (Solv-2) | 0.40 |
| 4th Layer (Ultraviolet Absorbing Layer): | |
| Gelatin | 1.58 |
| Ultraviolet absorbent (UV-1) | 0.47 |

-continued

| | Amount ($g/m^2$) |
|---|---|
| Color mixing inhibitor (Cpd-5) | 0.05 |
| Solvent (Solv-5) | 0.24 |
| 5th Layer (Red-Sensitive Layer): | |
| Silver chlorobromide emulsion (cubic grains; a 1:4 (by Ag mol) mixture of an emulsion having a mean grain size of 0.58 μm and a size variation coefficient of 0.09 and an emulsion having a mean grain size of 0.45 μm and a size variation coefficient of 0.11, both emulsions containing 0.6 mol % of AgBr on the limited part of the grain surface) | 0.23 |
| Gelatin | 1.34 |
| Cyan coupler (ExC) | 0.32 |
| Dye image stabilizer (Cpd-6) | 0.17 |
| Dye image stabilizer (Cpd-7) | 0.40 |
| Dye image stabilizer (Cpd-8) | 0.04 |

-continued

| | Amount ($g/m^2$) |
|---|---|
| Solvent (Solv-6) | 0.15 |
| 6th Layer (Ultraviolet Absorbing Layer): | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| 7th Layer (Protective Layer): | |
| Gelatin | 1.33 |
| Acryl-modified copolymer of polyvinyl alcohol (degree of modification: 17% and molecular weight: 80,000) | 0.17 |
| Liquid paraffin | 0.03 |

The couplers and other photographic additives used above are shown below.

Yellow Coupler (ExY):

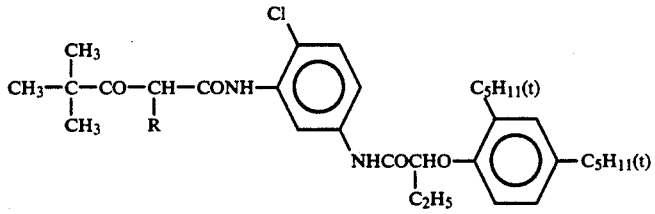

(wherein R:

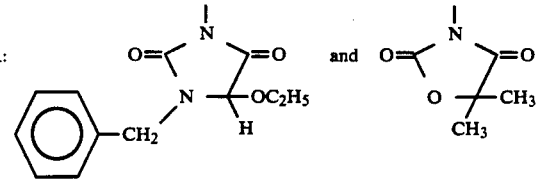

and

= 1:1 by mol)

Magenta Coupler (ExM):

1:1 (by mol) mixture of:

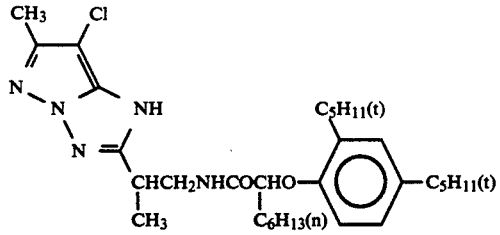

and

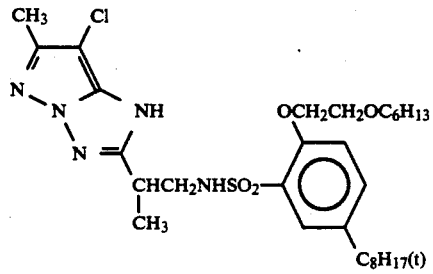

Cyan Coupler (ExC):

2:4:4 (by weight) mixture of:

-continued
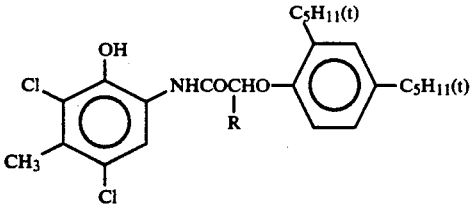
(wherein R: $C_2H_5$ and $C_4H_9$)
and
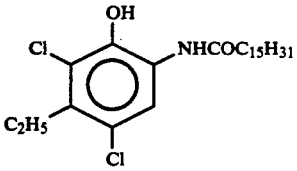
Dye Image Stabilizer (Cpd-1):
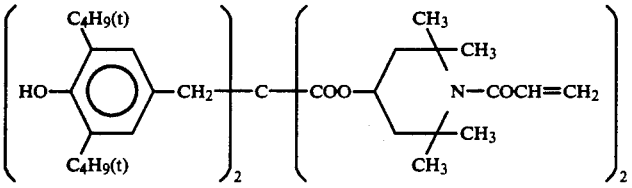
Dye Image Stabilizer (Cpd-2):
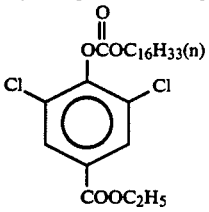
Dye Image Stabilizer (Cpd-3):
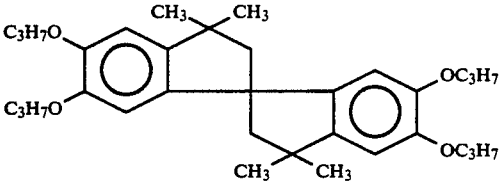
Dye Image Stabilizer (Cpd-4):
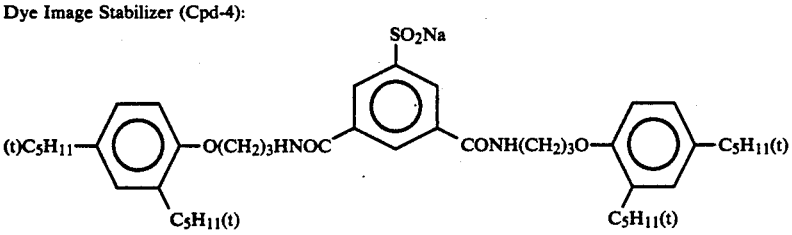
Color Mixing Inhibitor (Cpd-5):
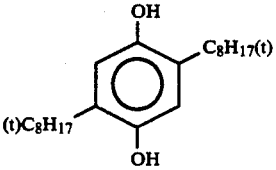
Dye Image Stabilizer (Cpd-6):
2:4:4 (by weight) mixture of (A), (B) and (C)

-continued
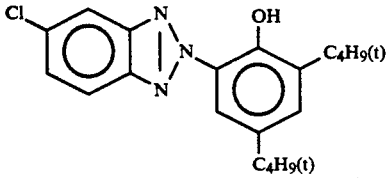
(A)
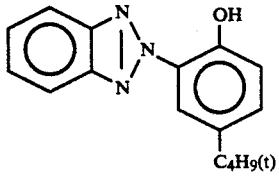
(B)
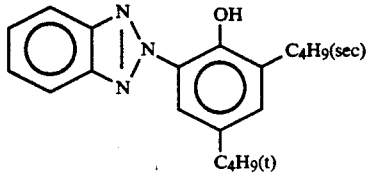
(C)
Dye Image Stabilizer (Cpd-7):
(Average Molecular Weight: 60,000)
Dye Image Stabilizer (Cpd-8):
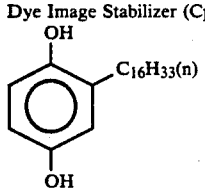
Dye Image Stabilizer (Cpd-9):
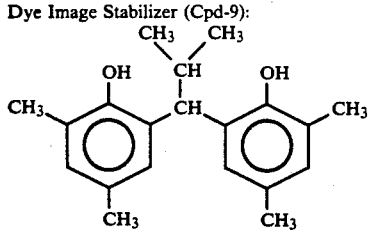
Ultraviolet Absorbent (UV-1):
4:2:4 (by weight) mixture of:
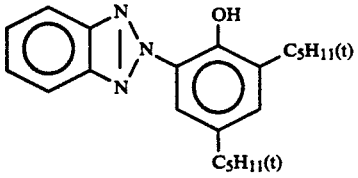
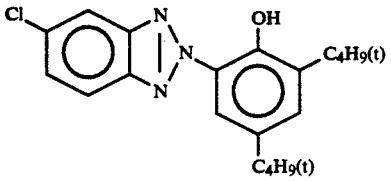
and -continued

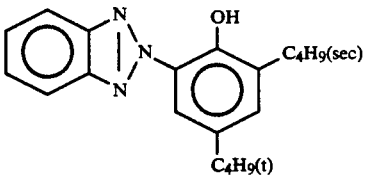

Solvent (Solv-1):

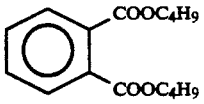

Solvent (Solv-2):
2:1 (by volume) mixture of:

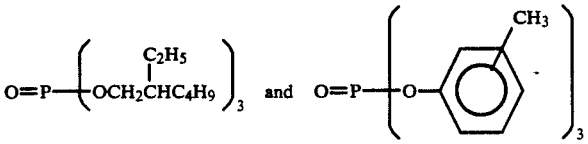

Solvent (Solv-4):

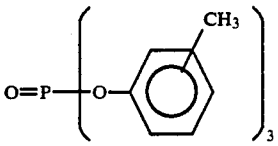

Solvent (Solv-5):

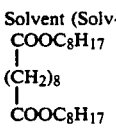

Solvent (Solv-6):

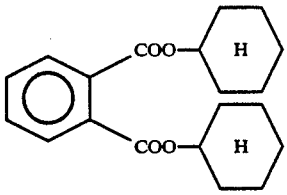

The thus prepared sample was imagewise exposed to light and subjected to a running test using a paper processing machine according to the following processing schedule.

| Processing Step | Temp. (°C.) | Time (sec) | Rate of Replenishment (ml/m²) | Volume of Tank (l) |
|---|---|---|---|---|
| Color Development | 35 | 45 | 161 | 17 |
| Bleach-Fix | 30–35 | 45 | 200 | 17 |
| Rinsing (1) | 30–35 | 30 | — | 10 |
| Rinsing (2) | 30–35 | 30 | — | 10 |
| Rinsing (3) | 30–35 | 30 | 350 | 10 |
| Drying | 70–80 | 60 | | |

Rinsing was carried out in a counter-flow system of from tank (3) toward tank (1).

Each processing solution had the following formulation:

| | Running Solution | Replenisher |
|---|---|---|
| Color Developing Solution: | | |
| Water | 800 ml | 800 ml |
| Ethylenediamine-N,N,N',N'-tetramethylenephosphonic acid | 3.0 g | 3.0 g |
| Potassium bromide | 0.010 g | — |
| Triethanolamine | 8.0 g | 12.0 g |
| Sodium chloride | 1.5 g | — |
| Potassium bromide | 25 g | 25 g |
| N-Ethyl-N-(β-methanesulfonamidoethyl)-3-methyl-4-aminoaniline sulfate | 5.0 g | 7.0 g |
| N,N-Dicarboxyethylhydroxylamine | 5.5 g | 7.0 g |
| Fluorescent brightening agent ("WHITEX 4" produced by Sumitomo Chemical Co., Ltd.) | 1.0 g | 1.5 g |
| Water to make | 1000 ml | 1000 ml |
| pH (25° C.) | 10.05 | 10.45 |
| Bleach-Fix Bath: | | |
| (Running solution and replenisher had the same formulation) | | |
| Water | | 400 ml |

-continued

| | Running Solution | Replenisher |
|---|---|---|
| Ammonium thiosulfate (70% w/v) | | 100 ml |
| Sodium sulfite | | 17 g |
| Ammonium (ethylenediaminetetraacetato)iron (III) | | 60 g |
| Disodium ethylenediaminetetraacetate | | 5 g |
| Water to make | | 1000 ml |
| pH (25° C.) (adjusted with glacial acetic acid) | | 5.60 |

Rinsing Solution (Running solution and replenisher had the same formulation) Deionized water having calcium and magnesium ions each reduced to 3 ppm or less. The overflow from the bleach-fix was pooled, and when its volume reached twice the tank volume (i.e., 34 l), a regenerant having the following formulation (per liter of the overflow) was added thereto. The thus regenerated overflow was utilized as a replenisher.

| Regenerant A: | |
|---|---|
| Ammonium thiosulfate (70% w/v) | 25 ml |
| Sodium sulfite | 0.07 mol |
| Ammonium (ethylenediaminetetra-acetato)iron (III) dihydrate | 10 g |
| Ethylenediaminetetraacetic acid | 2 g |
| Glacial acetic acid to adjust to a pH of 5.60 | |

Regenerant B

The same as Regenerant A, except for using a formaldehyde bisulfite adduct in place of sodium sulfite.

Regenerant C

The same as Regenerant A, except for using an acetaldehyde bisulfite adduct in place of sodium sulfite.

Regenerant D

The same as Regenerant A, except for using an 2-sulfobenzaldehyde bisulfite adduct in place of sodium sulfite.

Regenerant E

The same as Regenerant A, except for using a nicotinaldehyde bisulfite adduct in place of sodium sulfite.

Regenerant F

The same as Regenerant A, except for using a dihydroxyacetone bisulfite adduct in place of sodium sulfite.

The above-described regeneration operation was repeated 20 times by using each of Regenerants A to F. At this point, the above-prepared light-sensitive material was wedgewise exposed to light and processed according to the same processing schedule as described above. The regeneration rate was obtained as 100%.

In order to evaluate desilvering performance, the maximum density area of the processed sample was analyzed with fluorometry X-ray to determine the residual silver amount.

Further, the processed sample was preserved at 80° C. for 1 month, and the reduction of cyan density in the point whose initial cyan density was 2.0 was measured.

The results of these evaluations are shown in Table 1 below.

TABLE 1

| Run No. | Regenerating Agent | Residual Ag Amount ($\mu g/cm^2$) | Cyan Discoloration | Remark |
|---|---|---|---|---|
| 1 | A | 21 | −0.21 | Comparison |
| 2 | B | 28 | −0.19 | " |
| 3 | C | 7 | −0.10 | Invention |
| 4 | D | 2 | −0.11 | " |
| 5 | E | 3 | −0.10 | " |
| 6 | F | 6 | −0.13 | " |

It can be seen from the results in Table 1 that the present invention achieved improvements not only in desilvering performance but also in resistance to discoloration of a cyan dye. Particularly marked improvement in desilvering performance was obtained using Regenerants D and E. In using Regenerant B, there was observed precipitation of silver sulfide in the bleach-fix bath and the rinsing solution.

EXAMPLE 2

On a polyethylene-laminated (on both sides) paper support having been subjected to a corona discharge treatment, the layers shown below were coated in the order listed to prepare a multi-layer color paper. Coating compositions were prepared as follows.

Preparation of 1st Layer Coating Composition

To a mixture of 60.0 g of a yellow coupler (ExY) and 28.0 g of a discoloration inhibitor (Cpd-1) were added 150 ml of ethyl acetate, 1.0 ml of a solvent (Solv-3), and 3.0 ml of a solvent (Solv-4) to form a solution. The resulting solution was added to 450 ml of a 10% gelatin aqueous solution containing sodium dodecylbenzenesulfonate and dispersed in in ultrasonic homogenizer. The resulting dispersion was mixed with 420 g of a silver chlorobromide emulsion (silver bromide content: 0.7 mol %) containing a blue-sensitive sensitizing dye shown below to prepare a coating composition for a 1st layer.

Coating compositions for 2nd to 7th layers were prepared in the same manner as for the 1st layer coating composition. To each coating composition, 1,2-bis(-vinylsulfonyl)ethane was added as a gelatin hardening agent.

Spectral sensitizing dyes used in each light-sensitive layer are shown below.

Blue-Sensitive Layer

Anhydro-5,5'-dichloro-3,3'-disulfoethylthiacyanide hydroxide ($2\times10^{-10}$mol/mol-AgX)

Green-Sensitive Layer

Anhydro-9-ethyl-5,5'-diphenyl-3,3'-disulfoethyloxacarbocyanine hydroxide ($5\times10^{-4}$ mol/mol-AgX)

Red-Sensitive Layer 3,3'-Diethyl-5-methoxy-9,11-neopentylthiadicarbocyanine iodide ($2\times10^{-4}$ mol/mol-AgX)

Each of the emulsion layers contained, as a stabilizer, a 7:2:1 (by mole) mixture of 1-(2-acetaminophenyl)-5-mercaptotetrazole, 1-phenyl-5-mercaptotetrazole, and 1-(p-methoxyphenyl)-5-mercaptotetrazole.

Further, [3-carboxy-5-hydroxy-4-(3-(3-carboxy-5-oxo-1-(2,5-bisulfonatophenyl) -2-pyrazolin-4-ylidene)-1-propenyl)-1pyrazolyl]benzene-2,5-disulfonate disodium salt, N,N'-(4,8-dihydroxy -9,10-dioxo-3,7-disulfonatoanthracene-1,5diyl)bis(aminomethanesulfonate) tetrasodium salt, and [3-cyano-5-hydroxy-4-(3-(3-cyano-5-oxo-1-(4-sulfonatophenyl)-2-pyrazolin-4-ylidene)-1-pentanyl)-1-pyrazolyl]benzene-4-sulfonate sodium salt were used as anti-irradiation dyes.

The layer structure of the multi-layer color paper is shown below. The amount of silver halide emulsion is described in terms of silver coverage.

LAYER STRUCTURE

Support

Polyethylene-laminated paper, the polyethylene layer on the size to be coated with a 1st layer contained a white pigment ($TiO_2$) and a bluing dye (ultramarine), and the surface of the support having been subjected to a corona discharge treatment.

| | Amount ($g/m^2$) |
|---|---|
| 1st Layer (Blue-Sensitive Layer): | |
| Silver chlorobromide emulsion (cubic; mean grain size: 0.9 μm; AgBr content: 0.7 mol %) | 0.35 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| 2nd Layer (Color Mixing Preventive Layer): | |
| Gelatin | 0.80 |
| Color mixing inhibitor (Cpd-2) | 0.055 |
| Solvent (Solv-1) | 0.03 |
| Solvent (Solv-2) | 0.15 |
| 3rd Layer (Green-Sensitive Layer): | |
| Silver chlorobromide emulsion (cubic; mean grain size: 0.45 μm; AgBr content: 0.7 mol %) | 0.25 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.2 |
| Solvent (Solv-2) | 0.03 |
| 4th Layer (Color Mixing Preventive Layer): | |
| Gelatin | 1.70 |
| Color mixing inhibitor (Cpd-2) | 0.065 |
| Ultraviolet absorbent (UV-1) | 0.45 |
| Ultraviolet absorbent (UV-2) | 0.23 |
| Solvent (Solv-1) | 0.05 |
| Solvent (Solv-2) | 0.05 |
| 5th Layer (Red-Sensitive Layer): | |
| Silver chlorobromide emulsion (cubic; mean grain size: 0.5 μm; AgBr content: 4 mol %) | 0.25 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color formation accelerator (Cpd-5) | 0.15 |

-continued

| | Amount ($g/m^2$) |
|---|---|
| 6th Layer (Ultraviolet Absorbing Layer): | |
| Gelatin | 0.70 |
| Ultraviolet absorbent (UV-1) | 0.26 |
| Ultraviolet absorbent (UV-2) | 0.07 |
| Solvent (Solv-1) | 0.30 |
| Solvent (Solv-2) | 0.09 |
| 7th Layer (Protective Layer): | |
| Gelatin | 1.07 |

The couplers and other additives used above were as follows.

Discoloration Inhibitor (Cpd-1)

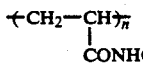

Average Mol. Wt.: 80,000

Color Mixing Inhibitor (Cpd-2)

2,5-Di-t-octylhydroquinone

Discoloration Inhibitor (Cpd-3)

7,7'-Dihydroxy-4,4,4',4'-tetramethyl-2,2'-spirochroman

Discoloration Inhibitor (Ccd-4)

N-(4-Dodecyloxyphenyl)-morpholine

Color Formation Accelerator (Cod-5)

p-(p-Toluenesulfonamido)phenyldodecane

Solvent (Solv-1)

Di(2-ethylhexyl) phthalate

Solvent (Solv-2)

Dibutyl phthalate

Solvent (Solv-3)

Di(i-nonyl)phthalate

Solvent (Solv-4)

N,N-Diethylcarbonamidomethoxy-2,4-di-t-amylbenzene

Ultraviolet Absorbent (UV-1)

2-(2-Hydroxy-3,5-di-t-amylphenyl)benzotriazole

Ultraviolet Absorbent (UV-2)

2-(2-Hydroxy-3,5-di-t-butylphenyl)benzotriazole

Yellow Coupler (ExY):

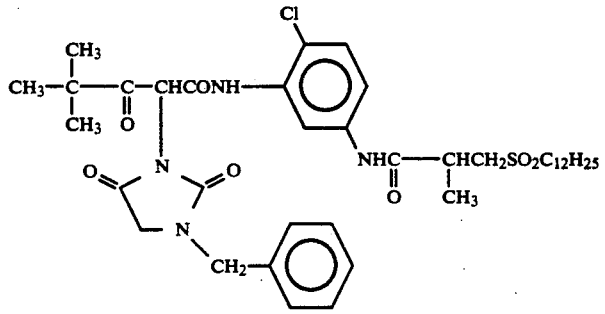

-continued

Magenta Coupler (ExM):

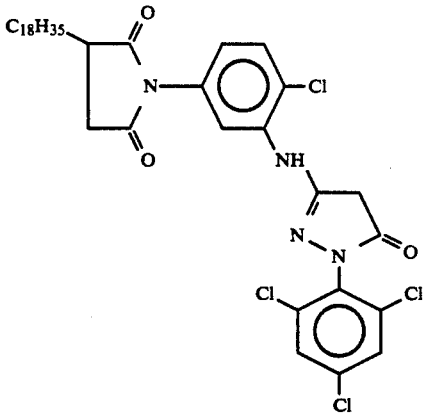

Cyan Coupler (ExC-1):

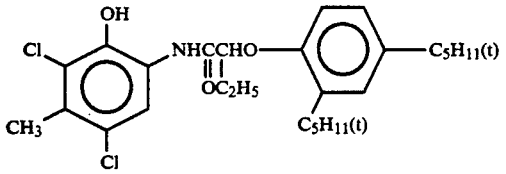

ExC-1

Cyan Coupler (ExC-2):

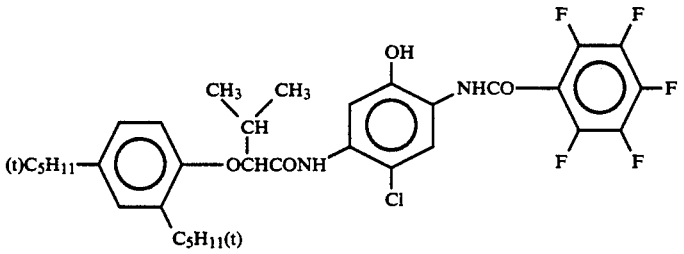

The thus prepared color paper was designated Sample 2A. Samples 2B to 2D were prepared in the same manner as Sample 2A, except for changing the silver coverage of the 1st, 3rd, and 5th, layers as shown in Table 2 below.

TABLE 2

| Sample No. | Silver Coverage ($g/m^2$) 1st Layer | 3rd Layer | 5th Layer | Total |
|---|---|---|---|---|
| 2A | 0.35 | 0.25 | 0.25 | 0.85 |
| 2B | 0.30 | 0.20 | 0.25 | 0.75 |
| 2C | 0.25 | 0.20 | 0.20 | 0.65 |
| 2D | 0.20 | 0.20 | 0.20 | 0.60 |

Each of Samples 2A to 2D was imagewise exposed to light and continuously processed according to the following schedule:

| Processing Step | Temp. (°C.) | Time (sec) | Rate of Replenishment ($ml/m^2$) | Volume of Tank (l) |
|---|---|---|---|---|
| Color Development | 35 | 45 | 161 | 5 |
| Bleach-Fix | 30–36 | 30 | 161 | 5 |
| Stabilization (1) | 30–37 | 20 | — | 3 |
| Stabilization (2) | 30–37 | 20 | — | 3 |
| Stabilization (3) | 30–37 | 20 | — | 3 |
| Stabilization (4) | 30–37 | 30 | 248 | 3 |

-continued

| Processing Step | Temp. (°C.) | Time (sec) | Rate of Replenishment ($ml/m^2$) | Volume of Tank (l) |
|---|---|---|---|---|
| Drying | 70–85 | 60 | | |

Stabilization was carried out in a counter-flow system of from tank (4) toward tank (1).

Each processing solution had the following formulation:

| | Running Solution | Replenisher |
|---|---|---|
| Color Developing Solution: | | |
| Water | 800 ml | 800 ml |
| Diethylenetriaminepentaacetic acid | 2.0 g | 2.0 g |
| 5,6-Dihydroxybenzene-2,4-disulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent brightening agent (4,4'-diaminostilbene type) | 2.0 g | 2.5 g |

-continued

| | Running Solution | Replenisher |
|---|---|---|
| Water to make | 1000 ml | 1000 ml |
| pH (25° C.) | 10.05 | 10.45 |
| Bleach-Fix Bath: | | |
| (Running solution and replenisher had the same formulation) | | |
| Water | | 400 ml |
| Ammonium thiosulfate (70% w/v) | | 100 ml |
| Sodium sulfite | | 17 g |
| Ammonium (ethylenediaminetetraacetato)iron (III) | | 60 g |
| Disodium ethylenediaminetetraacetate | | 5 g |
| Glacial acetic acid | | 9 g |
| Water to make | | 1000 ml |
| pH (25° C.) | | 5.40 |
| Stabilizing Bath: | | |
| (Running solution and replenisher had the same formulation) | | |
| 1-Hydroxyethylidene-1,1-diphosphonic acid (60%) | | 1.5 g |
| Nitrilotrimethylenephosphonic acid (40%) | | 1.5 g |
| 5-Chloro-2-methyl-4-isothiazolin-3-one | | 0.02 g |
| 2-Methyl-4-isothiazolin-3-one | | 0.01 g |
| Fluorescent brightening agent | | 0.5 g |
| Aqueous ammonia (28%) | | 1.5 ml |
| Water to make | | 1000 ml |
| pH (25° C.) | | 7.0 |

The bleach-fix bath was regenerated with each of Regenerants G to I shown below and reused in the same manner as in Example 1.

| Regenerant G: | |
|---|---|
| Ammonium thiosulfate | 20 ml |
| Sodium sulfite | 0.1 mol |
| Ammonium (ethylenediaminetetraacetato iron (III) dihydrate | 15 g |
| Ethylenediaminetetraacetic acid | 2 g |
| pH (adjusted with glacial acetic acid) | 5.40 |

Regenerant H

The same as Regenerant G, except for replacing sodium sulfite with an o-sulfobenzaldehyde bisulfite adduct.

Regenerant I

The same as Regenerant G, except for replacing sodium sulfite with a nicotinaldehyde bisulfite adduct. The regeneration rate was obtained as 100%.

Desilvering performance and cyan discoloration were evaluated in the same manner as in Example 1. The results obtained are shown in Table 3 below.

TABLE 3

| Run No. | Sample No. | Regenerating Agent ($\mu g/cm^2$) | Residual Ag Amount | Cyan Discoloration | Remark |
|---|---|---|---|---|---|
| 1 | 2A | G | 21 | −0.18 | Comparison |

TABLE 3-continued

| Run No. | Sample No. | Regenerating Agent ($\mu g/cm^2$) | Residual Ag Amount | Cyan Discoloration | Remark |
|---|---|---|---|---|---|
| 2 | 2B | " | 20 | −0.18 | " |
| 3 | 2C | " | 19 | −0.18 | " |
| 4 | 2D | " | 18 | −0.18 | " |
| 5 | 2A | H | 9 | −0.11 | Invention |
| 6 | 2B | " | 8 | −0.11 | " |
| 7 | 2C | " | 2 | −0.09 | " |
| 8 | 2D | " | 2 | −0.08 | " |
| 9 | 2A | I | 9 | −0.11 | " |
| 10 | 2B | " | 8 | −0.11 | " |
| 11 | 2C | " | 2 | −0.08 | " |
| 12 | 2D | " | 2 | −0.08 | " |

According to the present invention (Run Nos. 5 to 12), the residual silver amount was reduced, and cyan discoloration was inhibited. These effects were particularly remarkable when silver coverage was not more than 0.65 g/m² (Run Nos. 7, 8, 11, and 12).

EXAMPLE 3

The layers shown below were coated on a polyethylene-laminated (on both sides) paper support in the order listed to prepare a multi-layer color paper. Coating compositions were prepared as follows.

Preparation of 1st Layer Coating Composition

To a mixture of 19.1 g of a yellow coupler (ExY), 4.4 g of a dye image stabilizer (Cpd-1), and 0.7 g of a dye image stabilizer (Cpd-7) were added 27.2 ml of ethyl acetate and 8.2 g of a solvent (Solv-3) to form a solution. The resulting solution was emulsified and dispersed in 185 ml of a 10% gelatin aqueous solution containing 8 ml of 10% sodium dodecylbenzenesulfonate.

Separately, to a cubic silver chlorobromide emulsion having a mean grain size of 0.85 μm and a variation coefficient of size distribution of 0.07 and containing 1.0 mol % of silver bromide on the limited part of the grain surface, each of two blue-sensitive sensitizing dyes shown below was added in an amount of $2.0\times10^{-4}$ mol/mol of Ag, respectively. The emulsion was then subjected to sulfur sensitization.

The above-prepared coupler dispersion and the finished emulsion were mixed to prepare a 1st layer coating composition having a formulation shown below.

Coating compositions for 2nd to 7th layers were prepared in the same manner as for the 1st layer coating composition.

To each coating composition, 1-hydroxy-3,5-dichloro-s-triazine sodium salt was added as a gelatin hardening agent.

The spectral sensitizing dyes used in each light-sensitive layer and their amounts are shown below.

Blue-Sensitive Layer:

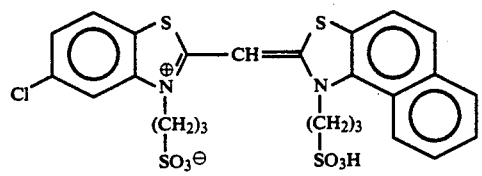

-continued

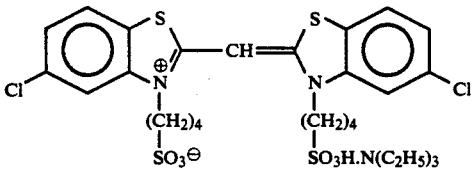

2.0 × $10^{-4}$ mol each/mol-AgX

Green-Sensitive Layer:

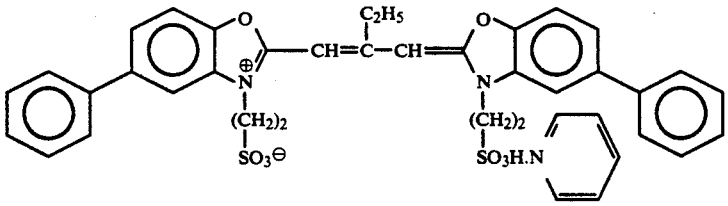

4.0 × $10^{-4}$ mol/mol-AgX

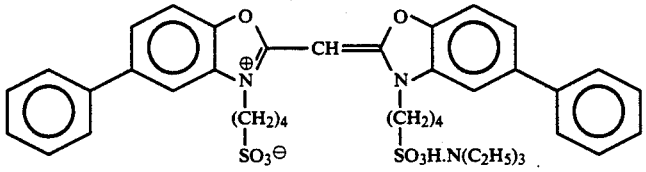

7.0 × $10^{-5}$ mol/mol-AgX

Red-Sensitive Emulsion Layer:

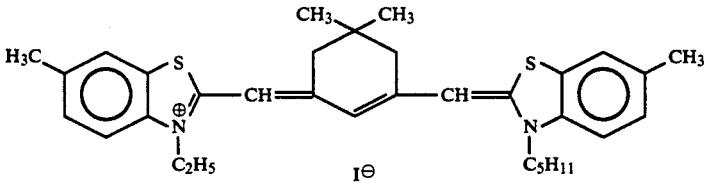

1.2 × $10^{-4}$ mol/mol-AgX

To the coating composition for a red-sensitive emulsion layer was added a compound shown below in an amount of $2.5\times10^{-3}$ mol/mol-AgX.

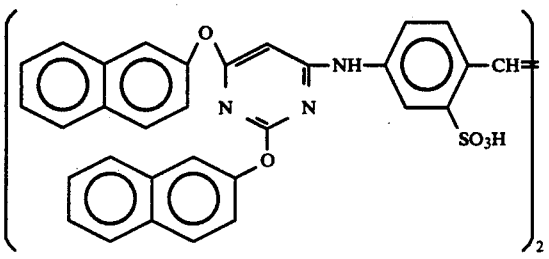

To each of the coating compositions for blue-, green- and red-sensitive emulsion layers was added 1-(5-methylureidophenyl)-5-mercaptotetrazole in an amount of $8.5\times10^{-5}$ mol, $7.7\times10^{-4}$ mol, and $2.5\times10^{-4}$ mol, respectively, per mol of AgX.

For the purpose of preventing irradiation, the following dyes were added to the green-sensitive and red-sensitive emulsion layers in an amount of 5 mg/$m^2$ respectively.

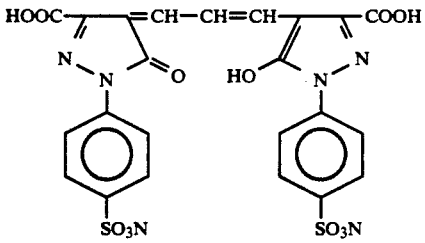

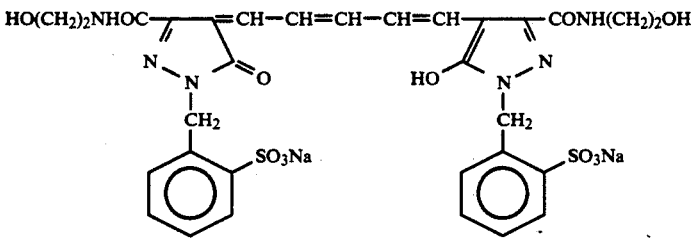

The layer structure of the multi-layer color paper is shown below. The amount of a silver halide emulsion is described in terms of silver coverage.

LAYER STRUCTURE

Support

Polyethylene-laminated paper, the polyethylene layer on the size coated with a 1st layer contained a white pigment ($TiO_2$) and a bluing dye (ultramarine).

| | Amount ($g/m^2$) |
|---|---|
| 1st Layer (Blue-Sensitive Layer): | |
| The above-described silver chlorobromide emulsion | 0.25 |
| Gelatin | 1.86 |
| Yellow coupler (ExY) | 0.82 |
| Dye image stabilizer (Cpd-1) | 0.19 |
| Dye image stabilizer (Cpd-7) | 0.03 |
| Solvent (Solv-3) | 0.35 |
| 2nd Layer (Color Mixing Preventive Layer): | |
| Gelatin | 0.99 |
| Color mixing inhibitor (Cpd-5) | 0.08 |
| Solvent (Solv-1) | 0.16 |
| Solvent (Solv-4) | 0.08 |
| 3rd Layer (Green-Sensitive Layer): | |
| Silver chlorobromide emulsion (cubic; grain size: 0.40 μm; size variation coefficient: 0.09; containing 1 mol % of AgBr on the limited part of the grain surface) | 0.36 |
| Gelatin | 1.24 |
| Magenta coupler (ExM) | 0.15 |
| Dye image stabilizer (Cpd-3) | 0.12 |
| Dye image stabilizer (Cpd-4) | 0.06 |

-continued

| | Amount ($g/m^2$) |
|---|---|
| Dye image stabilizer (Cpd-8) | 0.09 |
| Solvent (Solv-2) | 0.42 |
| Dye image stabilizer (Cpd-10) | 0.03 |
| Dye image stabilizer (Cpd-11) | 0.02 |
| 4th Layer (Ultraviolet Absorbing Layer): | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| 5th Layer (Red-Sensitive Layer): | |
| Silver chlorobromide emulsion (cubic; grain size: 0.36 μm; size variation coefficient: 0.11; containing 1.6 mol % of AgBr on the limited part of the grain surface) | 0.21 |
| Gelatin | 1.34 |
| Cyan coupler (ExC) | 0.27 |
| Dye image stabilizer (Cpd-6) | 0.17 |
| Dye image stabilizer (Cpd-7) | 0.34 |
| Dye image stabilizer (Cpd-9) | 0.04 |
| Solvent (Solv-6) | 0.37 |
| 6th Layer (Ultraviolet Absorbing Layer): | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| 7th Layer (Protective Layer): | |
| Gelatin | 1.33 |
| Acryl-modified copolymer of polyvinyl alcohol (degree of modification: 17% and molecular weight: 80,000) | 0.17 |
| Liquid paraffin | 0.03 |

The couplers and other additives used above were as follows.

Yellow Coupler (ExY):

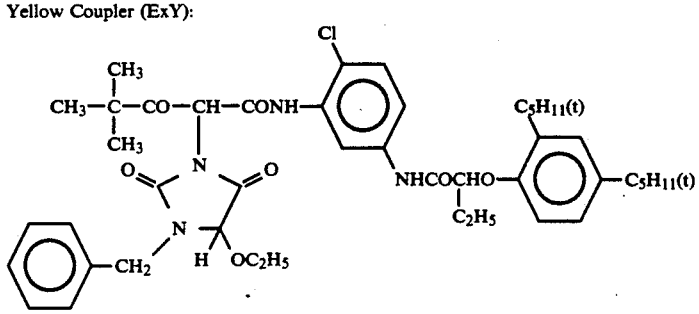

-continued
Magenta Coupler (ExM):
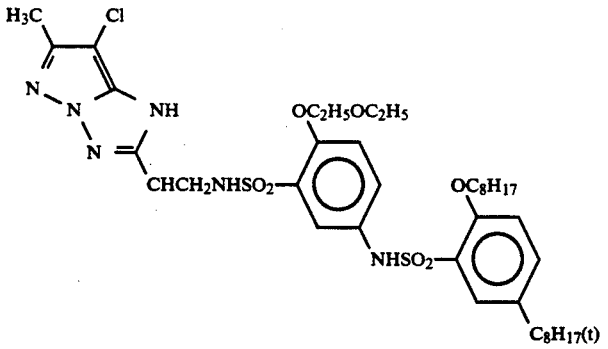
Cyan Coupler (ExC):
1:3:6 (by weight) mixture of:
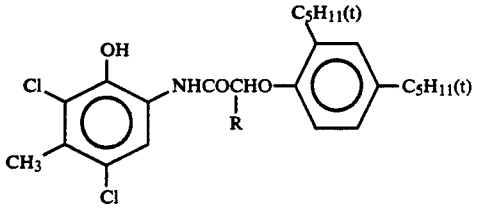
(wherein R: H, $C_2H_5$, and $C_4H_9$ = 1:3:6 (by weight))
Dye Image Stabilizer (Cpd-1):
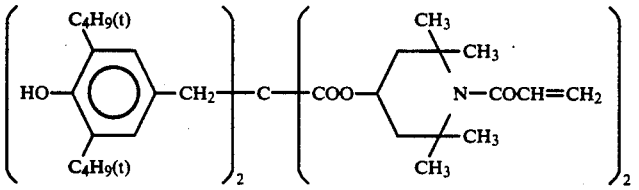
Dye Image Stabilizer (Cpd-3):
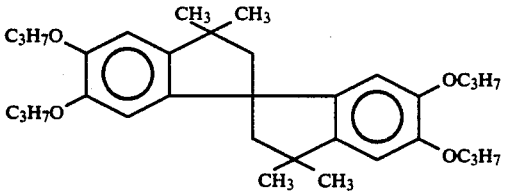
Dye Image Stabilizer (Cpd-4):
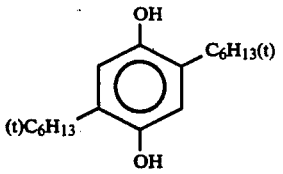
Color Mixing Inhibitor (Cpd-5):
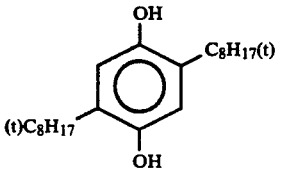
Dye Image Stabilizer (Cpd-6):
2:4:4 (by weight) mixture of (D), (E) and (F)

-continued
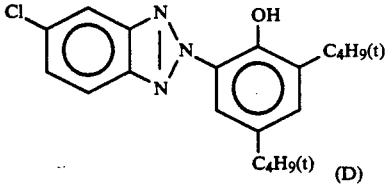
(D)
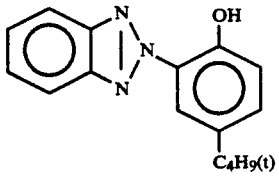
(E)
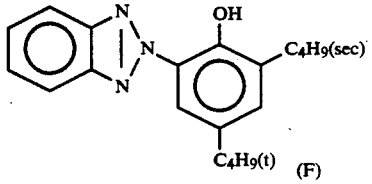
(F)
Dye Image Stabilizer (Cpd-7):
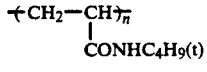
(Average Mol. Wt.: 60,000)
Dye Image Stabilizer (Cpd-8):
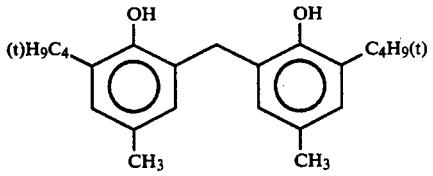
Dye Image Stabilizer (Cpd-9):
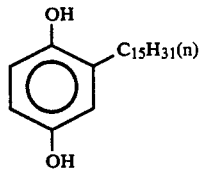
Ultraviolet Absorbent (UV-1):
4:2:4 (by weight) mixture of:
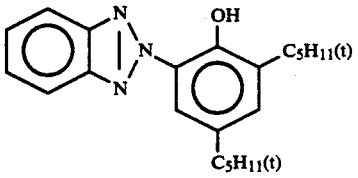
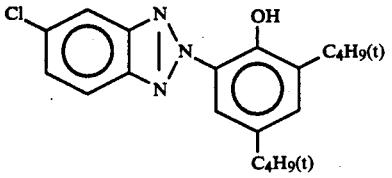

-continued
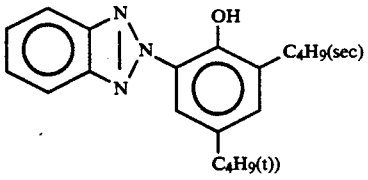
Solvent (Solv-1):
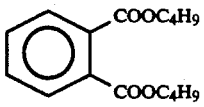
Solvent (Solv-2):
1:1 (by volume) mixture of:
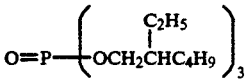
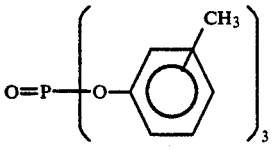
Solvent (Solv-3):
$O{=}P{\leftarrow}O{-}C_9H_{19}(iso))_3$
Solvent (Solv-4):
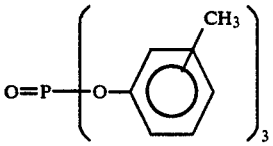
Solvent (Solv-5):
$$\begin{array}{l} COOC_8H_{17} \\ | \\ (CH_2)_8 \\ | \\ COOC_8H_{17} \end{array}$$
Solvent (Solv-6):
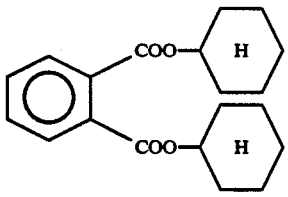
Dye Image Stabilizer (Cpd-10):
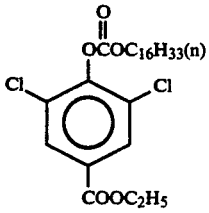
Dye Image Stabilizer (Cpd-11):

-continued

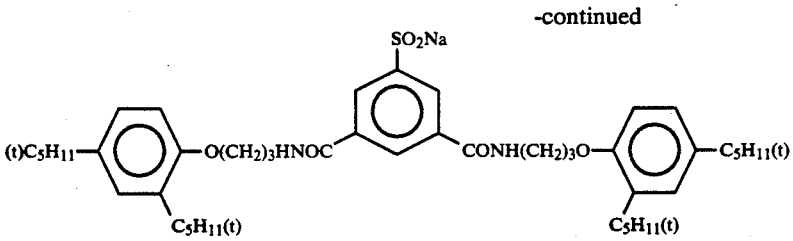

The thus prepared sample was imagewise exposed to light, and subjected to a running test according to the following processing schedule.

| Processing Step | Temp. (°C.) | Time (sec) | Rate of Replenishment (ml/ml) | Volume of Tank (l) |
|---|---|---|---|---|
| Color Development | 38 | 45 | 80 | 4 |
| Bleach-Fix | 30–36 | 45 | 100 | 4 |
| Washing (1) | 30–37 | 30 | — | 2 |
| Washing (2) | 30–37 | 30 | — | 2 |
| Washing (3) | 30–37 | 30 | 364 | 2 |
| Drying | 70–85 | 60 | | |

Washing was carried out in a counter-flow system of from tank (3) to tank (1).

Each processing solution had the following formulation:

| | Running Solution | Replenisher |
|---|---|---|
| Color Developing Solution: | | |
| Triethanolamine | 10 g | 10 g |
| Ethylenediamine-N,N,N',N'-tetramethylenephosphonic acid | 3.0 g | 3.0 g |
| Potassium chloride | 3.1 g | — |
| Potassium bromide | 0.015 g | — |
| Hydrazinoacetic acid | 3.5 g | 7.0 g |
| N-Ethyl-N-(β-methanesulfonamidoethyl)-3-methyl-4-aminoaniline sulfate | 4.75 g | 9.0 g |
| Fluorescent brightening agent ("WHITEX 4" produced by Sumitomo Chemical Co., Ltd.) | 1.25 g | 2.5 g |
| Potassium carbonate | 25 g | 25 g |
| Water to make | 1000 ml | 1000 ml |
| pH | 10.00 | 10.60 |
| Bleach-Fix Bath: | | |
| Ammonium thiosulfate (70% w/v) | 100 ml | 150 ml |
| Ammonium (ethylenediaminetetraacetato)iron (III) | 55 g | 70 g |
| Ammonium sulfite | 19 g | 38 g |
| Ammonium bromide | 12.5 g | 25 g |
| Ethylenediaminetetraacetic acid | 1.5 g | 3 g |
| Nitric acid (67%) | 24 g | 48 g |
| Water to make | 1000 ml | 1000 ml |
| pH | 5.20 | 5.00 |

Washing Water

Deionized water having calcium and magnesium ions each reduced to 3 ppm or less.

An overflow from the bleach-fix bath was collected, and when its volume reached 10 l, silver was recovered therefrom in an amount of about 90% dissolved in the overflow by the use of the electrolytic silver recovering apparatus shown in FIGS. 1 and 2 of JP-B-57-16345 under the same conditions as used in Example 1 thereof. Then, each of Regenerants J, K, and L having the following formulation (per liter of the overflow) was added thereto. The thus treated overflow was used as a regenerated replenisher. The above-described regeneration operation was repeated during the running test.

| Regenerant K: | |
|---|---|
| Ammonium thiosulfate (70% w/v) | 35 ml |
| Sodium sulfite | 0.13 mol |
| Ammonium (ethylenediaminetetraacetato)iron (III) dihydrate | 20 g |
| Ethylenediaminetetraacetic acid | 2 g |
| Glacial acetic acid to adjust to a pH of 5.00 | |

Regenerant K

The same as Regenerant J, except for replacing sodium sulfite with o-sulfobenzaldehyde bisulfite.

Regenerant L

The same as Regenerant J, except for replacing sodium sulfite with propionaldehyde and an equimolar amount of ammonium bisulfite. The regeneration rate was obtained as 100%.

Desilvering performance and cyan discoloration were evaluated in the same manner as in Example 1, and the results obtained are shown in Table 4.

TABLE 4

| Run No. | Regenerating Agent | Residual Ag Amount (μg/cm²) | Cyan Discoloration | Remark |
|---|---|---|---|---|
| 1 | J | 14 | −0.21 | Comparison |
| 2 | K | 2 | −0.11 | Invention |
| 3 | L | 4 | −0.11 | Comparison Invention |

As can be seen from Table 4, the present invention improved desilvering performance and reduced cyan discoloration.

As described above, the present invention provides a processing system which permits repeated regeneration of a bleach-fix bath and its reuse as a replenisher without causing insufficient desilvering or deterioration of image preservability, particularly thermal discoloration of a cyan dye, to thereby provide a processed silver halide color photographic material having excellent image quality.

While the invention has been described in detail and with reference to specific embodiments thereof, it will be apparent to one skilled in the art that various changes and modifications can be made therein without departing from the spirit and scope thereof.

What is claimed is:

1. A method for processing an exposed silver halide color photographic material comprising the steps of:

(a) color developing the exposed silver halide color photographic material;

(b) bleach-fixing said developed material with at least a bleach-fixing solution in a bleach-fixing tank;

(c) subjecting said bleach-fixed material to at least one of washing with water and stabilizing;

(d) regenerating a portion of a solution from said step (b) for bleach-fixing by adding thereto at least one replenishing agent comprising at least one carbonyl bisulfite adduct to form a replenisher solution; and (e) replenishing said bleach-fixing solution of step (b) with said replenisher solution from step (d)

wherein said replenishing of step (e) results in an overflow of the bleach-fixing solution from the bleach-fixing tank, a portion of said overflow solution is collected and regenerated to form the replenisher solution of step (d), and the regeneration rate defined as the amount of reused overflow divided by the total amount of overflow multiplied by 100 is greater than 80%.

2. The method as claimed in claim 1, wherein a color developing solution used in step (a) contains substantially no benzyl alcohol.

3. The method as claimed in claim 1, wherein said bleach-fixing solution comprises an aminopolycarboxylic acid iron (III) complex salt bleaching agent and has a pH of from 4.5 to 6.5.

4. The method as claimed in claim 1, wherein said replenisher is prepared in step (d) without removing or reducing the concentration of silver ions contained in said solution from step (b).

5. The method as claimed in claim 1, wherein said replenisher comprises a bleaching agent contained in said bleach-fixing solution, a fixing agent contained in said bleach-fixing solution, a preservative contained in said bleach-fixing solution, said carbonyl bisulfite adduct, and from 1 to 30 g/l of an organic or inorganic acid.

6. The method as claimed in claim 1, wherein said carbonyl bisulfite adduct comprises an aliphatic carbonyl compound having from 2 to 9 carbon atoms.

7. The method as claimed in claim 6, wherein said aliphatic carbonyl compound has from 2 to 7 carbon atoms.

8. The method as claimed in claim 1, wherein said carbonyl bisulfite adduct comprises an aromatic carbonyl compound comprising at least one member of the group consisting of a sulfo group, a carboxyl group, and a phospho group.

9. The method as claimed in claim 1, wherein said carbonyl bisulfite adduct is selected from the group consisting of:

(1) Acetaldehyde bisulfite adduct
(2) Propionaldehyde bisulfite adduct
(3) n-Butylaldehyde bisulfite adduct
(4) iso-Butylaldehyde bisulfite adduct
(5) Glutaraldehyde bisbisulfite adduct
(6) Succinaldehyde bisbisulfite adduct
(7) Malonaldehyde bisbisulfite adduct
(8) Maleinaldehyde bisbisulfite adduct
(9) β-Methylglutaraldehyde bisbisulfite adduct
(10) Glycolaldehyde bisulfite adduct
(11) o-Sulfobenzaldehyde bisulfite adduct
(12) Salicylaldehyde bisulfite adduct
(13) m-Nitrobenzaldehyde bisulfite adduct
(14) L-Glyceraldehyde bisulfite adduct
(15) Chloroacetaldehyde bisulfite adduct
(16) Bromoacetaldehyde bisulfite adduct
(17) Acetone bisulfite adduct
(18) Dihydroxyacetone bisulfite adduct
(19) Hydroxyacetone bisulfite adduct
(20) Pyruvic acid bisulfite adduct
(21) N-Acetylaminoacetic acid bisulfite adduct
(22) 3-Acetylpropionic acid bisulfite adduct
(23) 4-Acetylpropanol bisulfite adduct
(24) 4-Acetylbutyric acid bisulfite adduct
(25) Ethyl methylacetacetate bisulfite adduct
(26) Nicotinaldehyde bisulfite adduct
(27) Methyl ethyl ketone bisulfite adduct
(28) Acetylacetone bisulfite adduct
(29) Ethyl ethylacetacetate bisulfite adduct

10. The method as claimed in claim 9, wherein said carbonyl bisulfite adduct is selected from the group consisting of:

(1) Acetaldehyde bisulfite adduct
(2) Propionaldehyde bisulfite adduct
(5) Glutaraldehyde bisbisulfite adduct
(6) Succinaldehyde bisbisulfite adduct
(11) o-Sulfobenzaldehyde bisulfite adduct
(12) Salicylaldehyde bisulfite adduct
(13) m-Nitrobenzaldehyde bisulfite adduct
(19) Hydroxyacetone bisulfite adduct and
(26) Nicotinaldehyde bisulfite adduct

11. The method as claimed in claim 1, wherein said carbonyl bisulfite adduct has a molar ratio of carbonyl compound to bisulfite or sulfite of from 5:1 to 1:10.

12. The method as claimed in claim 11, wherein said carbonyl bisulfite adduct has a molar ratio of carbonyl compound to bisulfite or sulfite of from 1:1 to 1:5.

13. The method as claimed in claim 1, wherein said carbonyl bisulfite adduct is present in said replenisher in an amount from 0.01 to 1 mol per liter of said replenisher.

14. The method as claimed in claim 13, wherein said carbonyl bisulfite adduct is present in said replenisher in an amount from 0.01 to 0.3 mol per liter of said replenisher.

15. The method as claimed in claim 5, wherein said replenisher solution has a pH of from 4.0 to 6.0; comprises from 0.1 to 50 grams of said bleaching agent and from 2 to 50 g/l of said fixing agent; and said carbonyl bisulfite adduct is present in an amount of rom 0.01 to 1 mol per liter of said replenisher.

16. The method as claimed in clam 15, wherein said replenisher solution comprises from 1 to 30 g/l of said bleaching agent and from 10 to 30 g/l of said fixing agent; and said carbonyl bisulfite adduct is present in an amount of from 0.01 to 0.3 mol per liter of said replenisher.

17. The method as claimed in claim 15, wherein said replenisher is added to said bleach-fixing solution in step (b) in an amount of from 30 to 500 ml per $m^2$ of said color light-sensitive material processed.

18. The method as claimed in claim 17, wherein said replenisher is added to said bleach-fixing solution in step (b) in an amount of from 60 to 250 ml per $m^2$ of said color light-sensitive material processed.

19. The method as claimed in claim 1, wherein said silver halide color photographic material comprises a support having thereon light-sensitive silver halide grains containing at least one cyan coupler represented by formula (I):

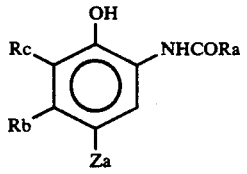

(I)

wherein

Ra represents an alkyl group, a cycloalkyl group, an aryl group, an amino group, or a heterocyclic group;

Rb represents an acylamino group or an alkyl group having at least 2 carbon atoms;

Rc represents a hydrogen atom, a halogen atom, an alkyl group, or an alkyoxy group; where Rc and Rb may be linked to form a ring; and Za represents a hydrogen atom, a halogen atom, or a coupling-off group.

20. The method as claimed in claim 1, wherein the regeneration rate is greater than 90%.

21. The method as claimed in claim 1, wherein a replenishing agent selected from a bleaching agent and a fixing agent is added to the portion of a solution from step (b) for bleach-fixing in addition to the at least one carbonyl bisulfite adduct to form the replenisher solution.

22. The method as claimed in claim 1, wherein a bleaching agent, a fixing agent, a preservative and an acid are added as a regenerant to the solution from step (b) to form a replenisher solution.

23. A method for continuously processing an imagewise exposed silver halide color photographic material comprising the steps of:

(a) color developing the exposed silver halide color photographic material;

(b) bleach-fixing said developed material with at least a bleach-fixing solution in a bleach-fixing tank and supplying a replenisher to the bleach-fixing tank to result in an overflow of from 30 to 500 ml/m$^2$ of the photographic material processed;

(c) subjecting said bleach-fixed material to at least one of washing with water and stabilizing;

(d) collecting the overflow from the bleach-fixing tank;

(e) regenerating at least a portion of the collected bleach-fixing overflow by adding thereto at least one replenishing agent comprising at least one carbonyl bisulfite adduct to form a bleach-fixing replenisher solution; and (f) replenishing said bleach-fixing solution of step (b) with said replenisher solution from step (e), wherein the regeneration rate defined as the amount of bleach-fixing overflow used for regeneration divided by the total amount of overflow multiplied by 100% is over 80%.

24. The method as claim in claim 23, wherein the regeneration rate is over 90%.

25. The method as claimed in claim 23, wherein a bleaching agent, a fixing agent, a preservative and an acid are added to the collected bleach-fixing overflow to form the bleach-fixing replenisher solution.

26. The method as claimed in claim 23, wherein components accumulated int he bleach-fixing solution during the continuous processing are not removed from the regenerated bleach-fixing replenisher.

* * * * *